US009272517B2

(12) United States Patent
Kawamura et al.

(10) Patent No.: US 9,272,517 B2
(45) Date of Patent: Mar. 1, 2016

(54) LIQUID DISCHARGE HEAD AND RECORDING DEVICE USING THE SAME

(71) Applicant: KYOCERA Corporation, Kyoto-shi, Kyoto (JP)

(72) Inventors: Hiroyuki Kawamura, Kirishima (JP); Daisuke Hozumi, Kirishima (JP); Wataru Ikeuchi, Kirishima (JP); Kenichi Yoshimura, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/423,298

(22) PCT Filed: Aug. 30, 2013

(86) PCT No.: PCT/JP2013/073424

§ 371 (c)(1),
(2) Date: Feb. 23, 2015

(87) PCT Pub. No.: WO2014/034892

PCT Pub. Date: Mar. 6, 2014

(65) Prior Publication Data

US 2015/0224766 A1 Aug. 13, 2015

(30) Foreign Application Priority Data

Aug. 30, 2012 (JP) ..... 2012-190266
May 28, 2013 (JP) ..... 2013-112042

(51) Int. Cl.
*B41J 2/14* (2006.01)

(52) U.S. Cl.
CPC ..... *B41J 2/1433* (2013.01); *B41J 2/14201* (2013.01); *B41J 2/14209* (2013.01); *B41J 2002/14217* (2013.01); *B41J 2002/14225* (2013.01); *B41J 2002/14306* (2013.01); *B41J 2002/14459* (2013.01); *B41J 2202/11* (2013.01)

(58) Field of Classification Search
None
See application file for complete search history.

(56) References Cited

U.S. PATENT DOCUMENTS 5,495,270 A 2/1996 Burr et al.
5,880,756 A 3/1999 Ishii et al.
6,783,207 B1 8/2004 Seto et al.

(Continued)

FOREIGN PATENT DOCUMENTS

EP 0661156 A2 7/1995
JP H7-144410 A 6/1995

(Continued)

OTHER PUBLICATIONS

International Search Report, PCT/JP2013/073424, Date of Mailing: Dec. 3, 2013, 2 pgs.

(Continued)

*Primary Examiner* — Justin Seo
(74) *Attorney, Agent, or Firm* — Volpe and Koenig, P.C.

(57) ABSTRACT

The present invention provides a liquid discharge head that causes less deviation in a discharge direction of a liquid from a direction orthogonal to a discharge hole surface, and a recording device using the liquid discharge head. The liquid discharge head of the present invention includes a discharge hole, a discharge hole surface having an opening of the discharge hole, a pressurizing chamber, and a flow channel connecting the discharge hole and the pressurizing chamber. The flow channel includes a nozzle part and a partial flow channel.

23 Claims, 16 Drawing Sheets

(56) References Cited

U.S. PATENT DOCUMENTS

| | | | | |
|---|---|---|---|---|
| 2002/0153435 | A1 | 10/2002 | Udagawa et al. | |
| 2004/0041885 | A1* | 3/2004 | Hirota | B41J 2/14209 347/72 |
| 2004/0066430 | A1 | 4/2004 | Sekiguchi | |
| 2004/0130604 | A1 | 7/2004 | Watanabe et al. | |
| 2006/0082618 | A1* | 4/2006 | Ito | B41J 2/14209 347/68 |
| 2006/0197809 | A1 | 9/2006 | Tobita et al. | |
| 2007/0058010 | A1 | 3/2007 | Nagashima | |

FOREIGN PATENT DOCUMENTS

| | | | |
|---|---|---|---|
| JP | 7-195685 | A | 8/1995 |
| JP | 2002-286735 | A | 10/2002 |
| JP | 2003-305852 | A | 10/2003 |
| JP | 2004-114342 | A | 4/2004 |
| JP | 2004-122680 | A | 4/2004 |
| JP | 2004-284254 | A | 10/2004 |
| JP | 2006-88390 | A | 4/2006 |
| JP | 2006-272948 | A | 10/2006 |
| JP | 2007-30433 | A | 2/2007 |
| JP | 2007-076168 | A | 3/2007 |

OTHER PUBLICATIONS

Japanese Office Action with English concise explanation, Japanese Patent Application No. 2014-501354, Oct. 6, 2015, 10 pgs.

* cited by examiner

XN1 = XNmin + XNA

XN2 = XNmax – XNA

XNA = (XNmax - XNmin) / 3

XN3 = XNmin + XNB

XN4 = XE1 - XNB

XN5 = XE1 + XNB

XN6 = XE2 - XNB

XN7 = XE2 + XNB

XN8 = XNmax - XNB

XNB = (XNmax - XNmin) / 12

LIQUID DISCHARGE HEAD AND RECORDING DEVICE USING THE SAME

TECHNICAL FIELD

The present invention relates to a liquid discharge head and a recording device using the liquid discharge head.

BACKGROUND ART

As a liquid discharge head for use in inkjet type printing, there has been known one configured by laminating a flow channel member and an actuator unit. The flow channel member is obtained by laminating a plurality of plates, each having a manifold as a common flow channel, and discharge holes respectively connected to each other from the manifold via a plurality of pressurizing chambers. The actuator unit has a plurality of displacement elements respectively disposed so as to cover the pressurizing chambers (refer to, for example, patent document 1). In this liquid discharge head, the pressurizing chambers respectively connected to a plurality of the discharge holes are disposed in a matrix shape, and the displacement elements of the actuator unit disposed so as to cover the pressurizing chambers are configured to be displaced, thereby ensuring that ink is discharged from each of the discharge holes so as to perform printing at a predetermined resolution.

PRIOR ART DOCUMENT

Patent Document

Patent document 1: Japanese Unexamined Patent Publication No. 2003-305852

SUMMARY OF THE INVENTION

Problems to be Solved by the Invention

However, the liquid discharge head as described in the patent document 1 has suffered from problems. Firstly, a discharge hole surface having the discharge holes disposed thereon, and the flow channel extending from the pressurizing chambers to the discharge holes are not orthogonal to each other. Due to this, liquid drops are to be discharged in a direction deviated from a direction orthogonal to the discharge hole surface, thus causing misalignment of landing positions on a recording medium. Secondly, the angle formed by the flow channel and the discharge hole surface differs depending on the discharge hole, and hence the discharge angle of the liquid drops differs depending on the discharge hole. Therefore, the landing positions deviate differently, resulting in deterioration of printing accuracy.

Therefore, an object of the present invention is to provide a liquid discharge head that causes less deviation in a liquid discharge direction from the direction orthogonal to the discharge hole surface, and also provide a recording device using the liquid discharge head.

Means for Solving the Problems

A liquid discharge head of the present invention includes a flow channel member and a pressurizing part. The flow channel member includes one or a plurality of discharge holes, a discharge hole surface having an opening of the discharge hole, one or a plurality of pressurizing chambers, and one or a plurality of flow channels connecting the discharge hole and the pressurizing chamber. The pressurizing part is configured to pressurize a liquid in the pressurizing chamber. The flow channel includes a nozzle part with a cross section narrowed near the discharge hole, and a partial flow channel excluding the nozzle part. The partial flow channel is formed so that a distance between Cm and C1 in a direction parallel to the discharge hole surface is larger than 0.1 W [μm] and a distance between C2 and C1 in a direction parallel to the discharge hole surface is 0.1 W [μm] or less, wherein W [μm] is a mean diameter of the partial flow channel, C1 is an area centroid of a cross section parallel to the discharge hole surface on a side of the partial flow channel which is close to the nozzle part, C2 is an area centroid of a cross section parallel to the discharge hole surface at a position located 2 W [μm] away from a side of the partial flow channel which is close to the nozzle part in a direction orthogonal to the discharge hole surface, C3 is an area centroid of a cross section parallel to the discharge hole surface on a side of the partial flow channel which is close to the pressurizing chamber, and Cm is an intersection of a straight line connecting C1 and C3, and a plane parallel to the discharge hole surface at a position located 2 W [μm] away from the nozzle part in a direction orthogonal to the discharge hole surface. A recording device of the present invention includes the liquid discharge head, a transport section configured to transport a recording medium with respect to the liquid discharge head, and a control section configured to control a plurality of the pressurizing parts.

Alternatively, a liquid discharge head of the present invention includes a flat plate-shaped flow channel member that is long in a first direction and includes a plurality of discharge holes and a plurality of pressurizing chambers respectively connected to a plurality of the discharge holes. The liquid discharge head includes a plurality of pressurizing parts configured to respectively pressurize a liquid in a plurality of the pressurizing chambers. In a plan view of the flow channel member, a plurality of the pressurizing chambers are long in one direction and are respectively connected to a plurality of the discharge holes via a first connection end that is one of opposite ends in the one direction, a plurality of the pressurizing chambers include the pressurizing chambers respectively having three or more different values in a value of XN [mm]. A plurality of the pressurizing chambers include the pressurizing chamber that is positive in a maximum value XNmax [mm] of XN [mm] and is positive in XE [mm]. A plurality of the pressurizing chambers include the pressurizing chamber that is negative in a minimum value XNmin [mm] of XN [mm] and is negative in XE [mm]. Assuming that one end in the first direction in the flow channel member is taken as one end, and another end thereof is taken as another end, XE [mm] is a relative position of the first connection end of the pressurizing chamber with respect to an area centroid of the pressurizing chamber when a side of the one end in the first direction is positive, and XN [mm] is a relative position of the discharge hole connected to the pressurizing chamber with respect to the area centroid of the pressurizing chamber when the side of the one end in the first direction is positive. A recording device of the present invention includes the liquid discharge head, a transport section configured to transport a recording medium with respect to the liquid discharge head, and a control section configured to control a drive of the liquid discharge head.

Effect of the Present Invention

According to the present invention, the end of the flow channel extending from the pressurizing chamber to the discharge hole which is close to the pressurizing chamber, and the end of the flow channel which is close to the discharge hole are misaligned, and the flow channel is oblique with respect to the discharge hole surface. Even with this structure, the portion of the flow channel which is close to the discharge hole is approximately orthogonal to the discharge hole surface. This ensures a discharge less deviated from the direction orthogonal to the discharge hole surface.

PREFERRED EMBODIMENTS FOR CARRYING OUT THE INVENTION

Figure 1:
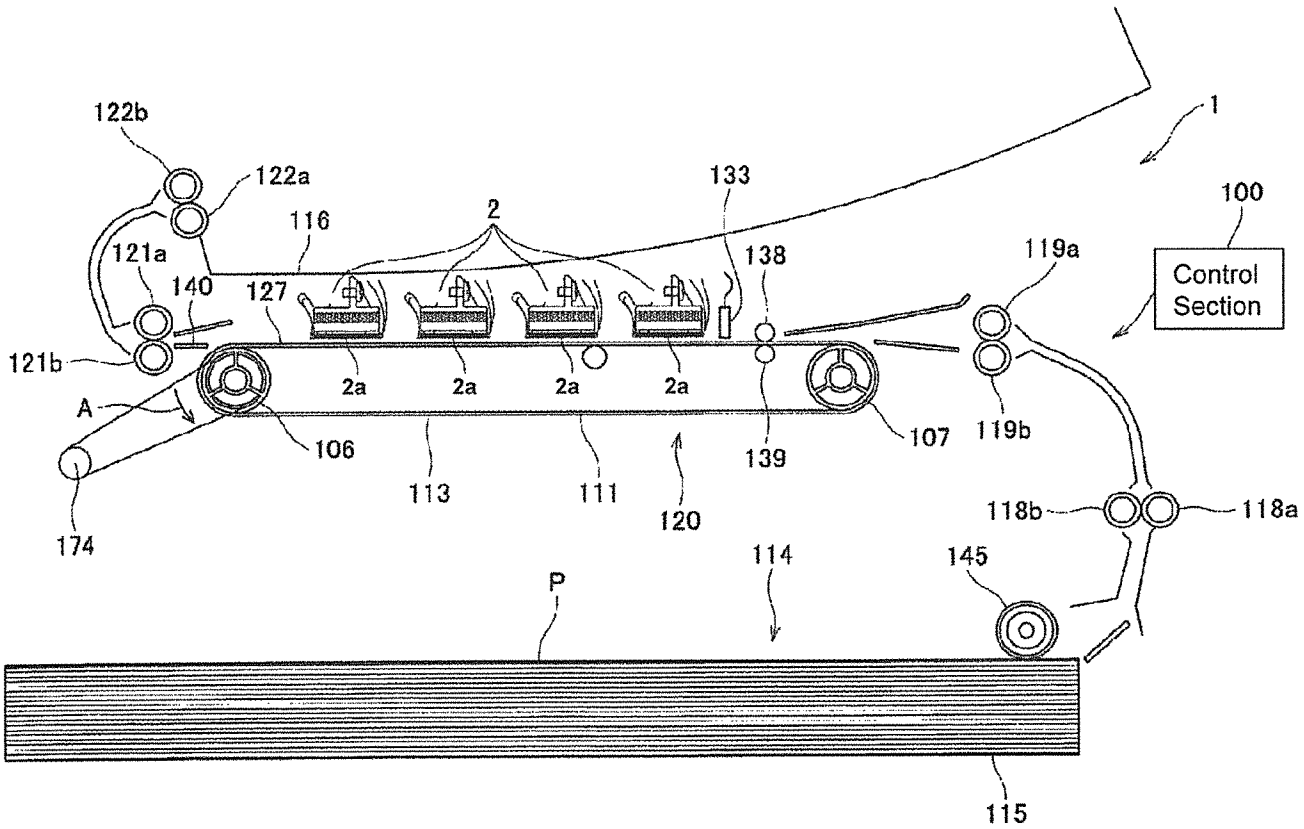
FIG. 1 is a schematic configuration diagram of a color inkjet printer that is a recording device including a liquid discharge head according to one embodiment of the present invention.

FIG. 1 is a schematic configuration diagram of a color Inkjet printer that is a recording device including a liquid discharge head according to one embodiment of the present invention. The color inkjet printer 1 (hereinafter referred to as the printer 1) includes the four liquid discharge heads 2. These liquid discharge heads 2 are disposed along a transport direction of a printing paper P, and the liquid discharge heads 2 secured to the printer 1 have an elongated shape that is slender in a direction from the near side to the rear side in FIG. 1. The elongated direction is generally referred to as a longitudinal direction.

The printer 1 includes a paper feed unit 114, a transport unit 120, and a paper receiving part 116, which are sequentially disposed along a transport path of a printing paper P. The printer 1 also includes a control section 100 to control individual components of the printer 1, such as the liquid discharge heads 2 and the paper feed unit 114.

The paper feed unit 114 includes a paper storage case 115 capable of storing a plurality of printing papers P, and a paper feed roller 145. The paper feed roller 145 is capable of feeding out one by one the printing paper P located uppermost among the printing papers P stackedly stored in the paper storage case 115.

Two pairs of rollers 118*a* and 118*b*, and 119*a* and 119*b* are disposed along the transport path for the printing papers P between the paper feed unit 114 and the transport unit 120. The printing paper P fed out of the paper feed unit 114 is guided by these feed rollers so as to be fed to the transport unit 120.

The transport unit 120 includes an endless transport belt 111 and two belt rollers 106 and 107. The transport belt 111 is wounded around the belt rollers 106 and 107. The transport belt 111 is adjusted to such a length as to be stretched under a predetermined tension when being wounded around the two belt rollers. This ensures that the transport belt 111 is stretched without looseness along two planes parallel to each other that respectively include common tangents of the two belt rollers. One of these two planes which is close to the liquid discharge head 2 is a transport surface 127 along which the printing papers P are transported.

A transport motor 174 is connected to the belt roller 106 as shown in FIG. 1. The transport motor 174 is capable of rotating the belt roller 106 in an arrowed direction A. The belt roller 107 is rotatable interlockingly with the transport belt 111. Accordingly, the transport motor 174 is driven to rotate the belt roller 106 so as to ensure that the transport belt 111 is moved along the arrowed direction A.

A nip roller 138 and a nip receiving roller 139 are disposed in the vicinity of the belt roller 107 so as to hold the transport belt 111 therebetween. The nip roller 138 is energized downward by an unshown spring. The nip receiving roller 139 below the nip roller 138 receives the downwardly energized nip roller 133 with the transport belt 111 interposed therebetween. The two nip rollers are disposed rotatably so as to rotate interlockingly with the transport belt 111.

The printing paper P fed from the paper feed unit 114 to the transport unit 120 is nipped between the nip roller 138 and the transport belt 111. This ensures that the printing paper P is pressed against the transport surface 127 of the transport belt 111 so as to be fixed onto the transport surface 127. According to the rotation of the transport belt 111, the printing paper P is then transported in the direction in which the liquid discharge head 2 is disposed. Alternatively, an outer peripheral surface 113 of the transport belt 111 may be subjected to processing with adhesive silicone rubber. This allows the printing paper P to be surely fixed to the transport surface 127.

The liquid discharge head 2 has a head body 2*a* at the lower-end thereof. A lower surface of the head body 2*a* is a discharge hole surface 4-1 having thereon a large number of discharge holes for discharging the liquid.

Liquid drops (ink) having the same color are to be discharged from the discharge holes 8 disposed on the single liquid discharge head 2. A liquid is to be supplied from an unshown external liquid tank to each of the liquid discharge heads 2. The discharge holes 8 of the liquid discharge heads 2 respectively have an opening on the discharge hole surface 4-1, and are equally spaced in one direction (the direction that is parallel to the printing paper P and is orthogonal to the transport direction of the printing paper P, namely, the longitudinal direction of the liquid discharged heads 2). This ensures printing in the one direction without leaving any blank space. The colors of liquids to be discharged from the liquid discharge heads 2 are respectively, for example, magenta (M), yellow (Y), cyan (C), and black (K). The liquid discharge heads 2 are disposed between the lower surface of the liquid discharge head body 13 and the transport surface 127 of the transport belt 111 with a slight space left therebetween.

The printing paper P that is already transported by the transport belt 111 is then passed through the gap between the liquid discharged head 2 and the transport belt 111. On that occasion, the liquid drops are to be discharged from the head body 2*a* constituting the liquid discharge head 2 toward the upper surface of the printing paper P. Consequently, a color image on the basis of image data stored by the control section 100 is formed on the upper surface of the printing paper P.

A peel-off plate 140 and two pairs of feed rollers 121*a* and 121*b*, and 122*a* and 122*b* are disposed between the transport unit 120 and the paper receiving part 116. The printing paper P having the color image printed thereon is then transported to the peel-off plate 140 by the transport belt 111. On that occasion, the printing paper P is peeled off from the transport surface 127 by the right end of the peel-off plate 140. The printing paper P is then fed to the paper receiving part 116 by the feed rollers 121*a* to 122*b*. Thus, the printing papers P after being subjected to the printing are sequentially fed to the paper receiving part 116 so as to be stacked on the paper receiving part 116.

A paper surface sensor 133 is disposed between the nip roller 138 and the liquid discharge head 2 located on the most upstream side in the transport direction of the printing paper P. The paper surface sensor 133 is made up of a light-emitting device and a light-receiving device, and is capable of detecting a front end position of the printing paper P on the transport path. A detection result obtained by the paper surface sensor 133 is transmitted to the control section 100. The control section 100 is capable of controlling, for example, the liquid discharge heads 2 and the transport motor 174 so as to establish synchronization between the transport of the printing paper P and the printing of the image according to the detection result transmitted from the paper surface sensor 133.

Figure 2:
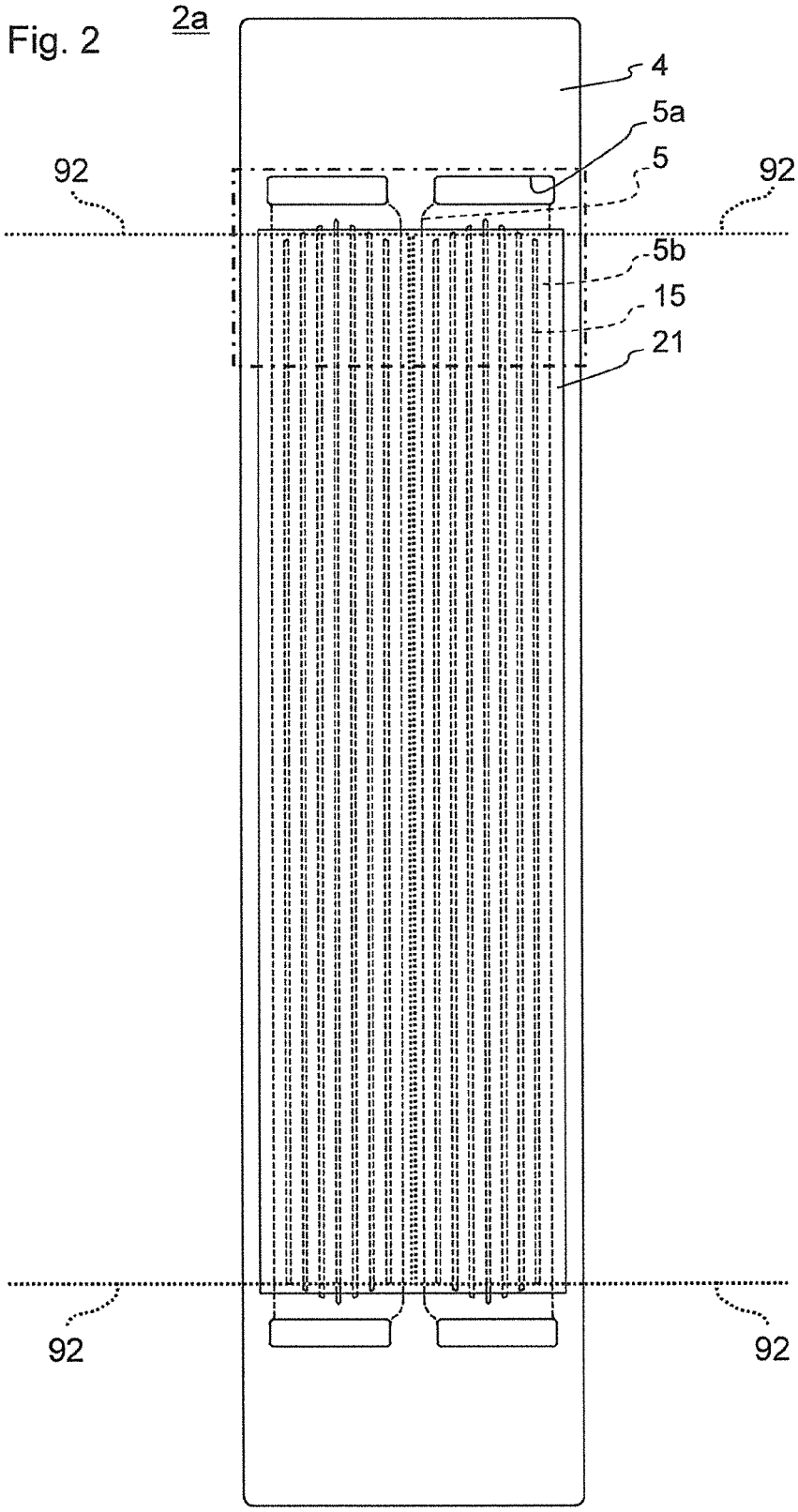
FIG. 2 is a plan view of a flow channel member and a piezoelectric actuator that constitute the liquid discharge head of FIG. 1.
Figure 3:
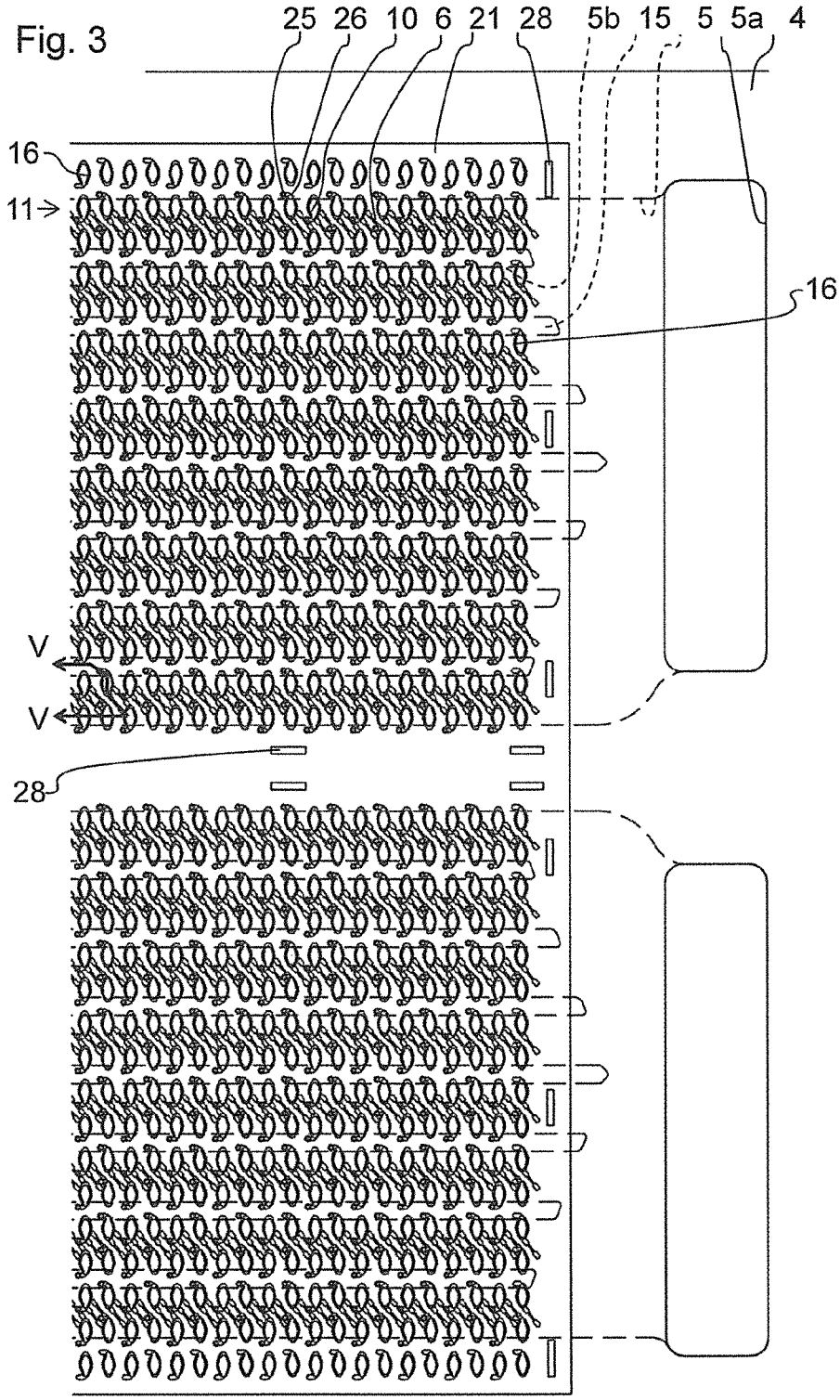
FIG. 3 is an enlarged view of a region surrounded by an alternate long and short dash line of FIG. 2, with some flow channels omitted for the sake of description.
Figure 4:
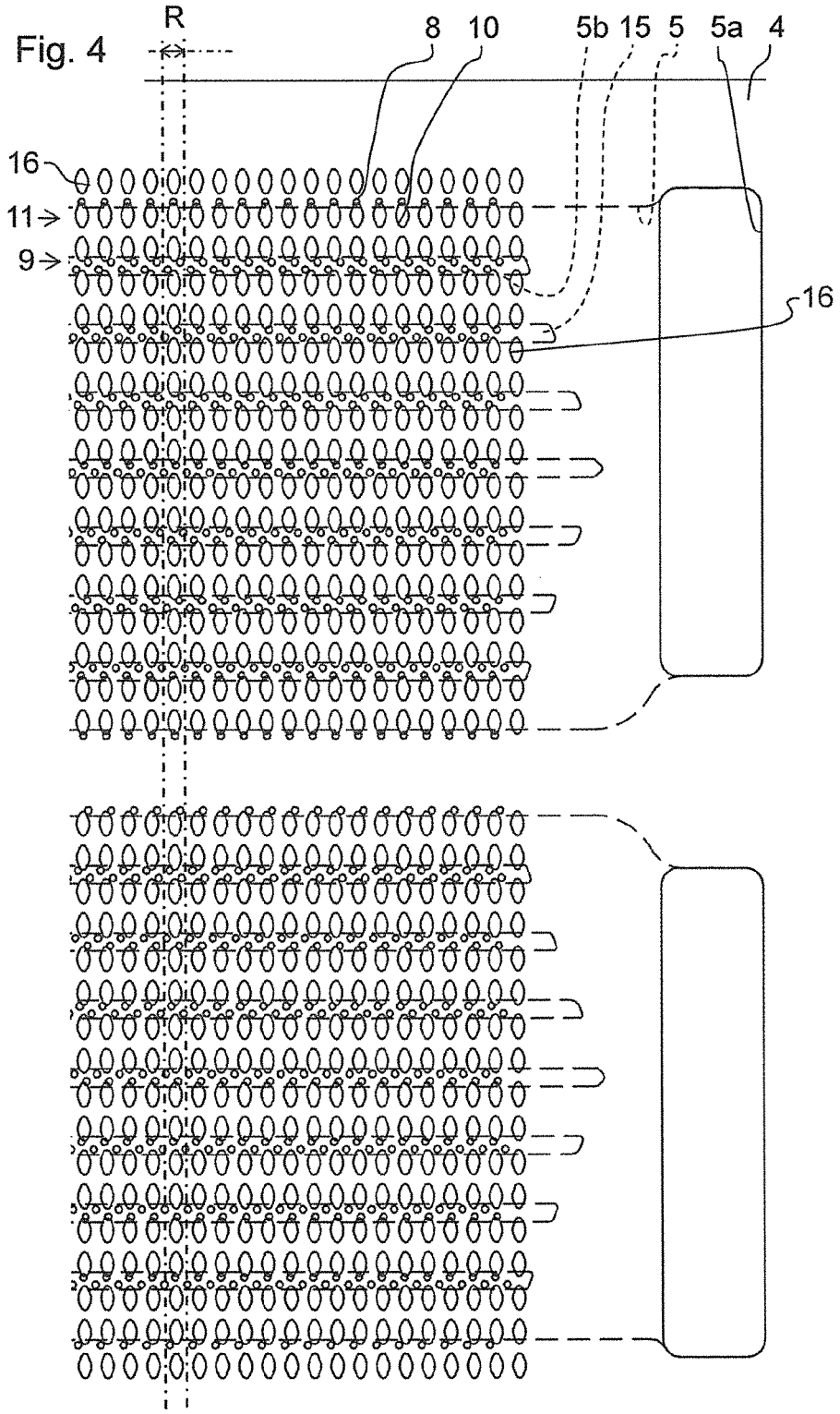
FIG. 4 is an enlarged view of a region surrounded by an alternate long and short dash line of FIG. 2, with some flow channels omitted for the sake of description.
Figure 5:
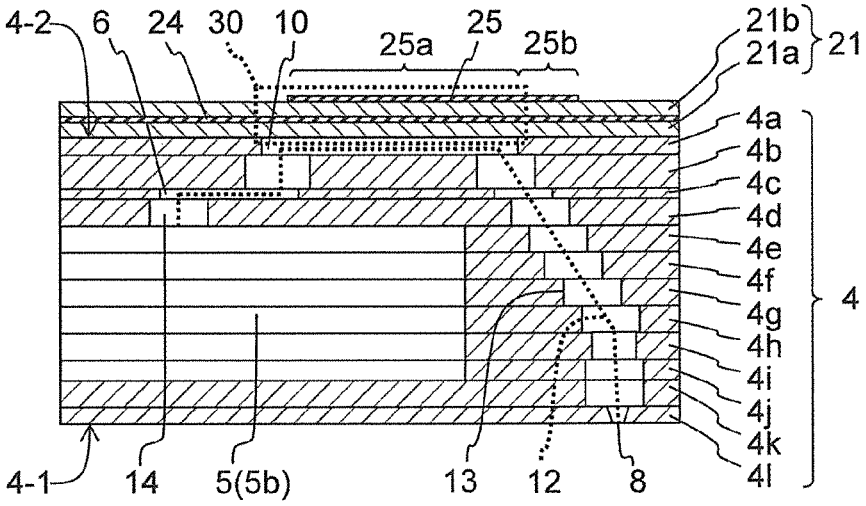
FIG. 5 is a longitudinal cross sectional view taken along the line V-V in FIG. 3.
Figure 6:
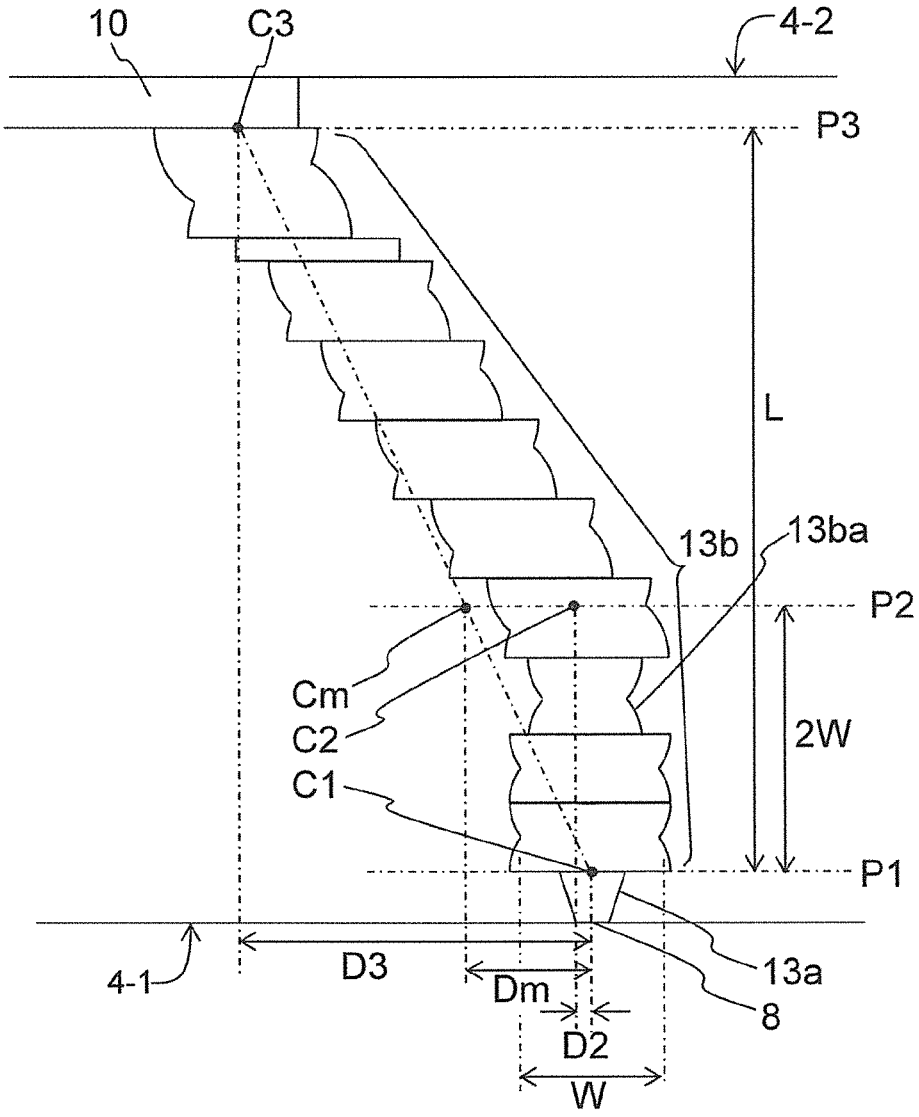
FIG. 6 is a partially enlarged cross sectional view of FIG. 5.

The liquid discharge heads 2 of the present invention are described below. FIG. 2 is a plan view of the head body 2*a*. FIG. 3 is an enlarged view of a region surrounded by an alternate long and short dash line of FIG. 2, and is also a plan view in which some flow channels are omitted for the sake of description. FIG. 4 is an enlarged view of the region surrounded by the alternate long and short dash line of FIG. 2, and is also an enlarged view in which some flow channels different from those in FIG. 3 are omitted for the sake of description. In FIGS. 3 and 4, for the purpose of further clarification of the drawings, apertures 6, the discharge holes 8, and the pressurizing chambers 10, which are respectively located below a piezoelectric actuator substrate 21 and therefore should be drawn by a dashed line, are drawn by a solid line. The diameter of the discharge holes 8 in FIG. 4 is drawn larger than the actual diameter for the purpose of further clarification of their positions. FIG. 5 is a longitudinal cross sectional view taken along the line V-V in FIG. 3. FIG. 6 is a cross sectional view showing in enlarged dimension a part of FIG. 5. The longitudinal cross-sectional shape of the hole constituting a partial flow channel (descender) 13*b* in FIG. 6 shows in detail a shape to be made when produced by etching, but is ommittedly and schematically shown in FIG. 5.

The liquid discharge heads 2 may include a reservoir and a metal housing besides the head body 2*a*. The head body 2*a* includes the flow channel member 4, and the piezoelectric actuator substrate 21 with a displacement device (pressurizing part) 30 fabricated therein.

The flow channel member 4 constituting the head body 2*a* includes a manifold 5 that is a common flow channel, a plurality of the pressurizing chambers 10 connected to the manifold 5, and a plurality of the discharge holes 8 respectively connected to a plurality of the pressurizing chambers 10. The pressurizing chambers 10 respectively have an opening on the upper surface of the flow channel member 4, and the upper surface of the flow channel member 4 serves as a pressurizing chamber surface 4-2. The upper surface of the flow channel member 4 includes an opening 5*a* to be connected to the manifold 5, and the liquid is to be supplied through the opening 5*a*.

The piezoelectric actuator substrate 21 including the displacement devices 30 is connected to the upper surface of the flow channel member 4, and the displacement devices 30 are disposed so as to be located on the pressurizing chambers 10. A signal transmission section 92, such as an FPC (flexible printed circuit) for supplying a signal to the displacement devices 30 is connected to the piezoelectric actuator substrate 21. In FIG. 2, the outline of the vicinity of the signal transmission section 92, which is to be connected to the piezoelectric actuator substrate 21, is indicated by a dotted line in order to facilitate understanding of a situation where the two signal transmission sections 92 are connected to the piezoelectric actuator substrate 21. Electrodes formed on the signal transmission sections 92, which are electrically connected to the piezoelectric actuator substrate 21, are disposed in a rectangular shape at end portions of the signal transmission sections 92. The two signal transmission sections 92 are connected so that their respective ends are located in a middle part in the lateral direction of the piezoelectric actuator substrate 21. The two signal transmission sections 92 extend from the middle part toward long sides of the piezoelectric actuator substrate 21.

The head body 2*a* includes the flat plate-shaped flow channel member 4 and the single piezoelectric actuator substrate 21 including the displacement devices 30 connected onto the flow channel member 4. A planar shape of the piezoelectric actuator substrate 21 is a rectangular shape, and the piezoelectric actuator substrate 21 is disposed on the upper surface of the flow channel member 4 so that the long sides of the rectangle extend along the longitudinal direction of the flow channel member 4.

The two manifolds 5 are formed inside the flow channel member 4. The manifolds 5 have a slender shape that extends from one end side to the other end side in the longitudinal direction of the flow channel member 4, and these two ends are respectively provided with the opening 5*a* of the manifold that opens on the upper surface of the flow channel member 4.

A middle portion of the manifold 5 in the length direction thereof, which is the region connected to at least the pressurizing chamber 10, is partitioned by a partition wall 15 disposed with a gap in a width direction. A middle portion of the partition wall 15 in the length direction thereof, which is the region connected to the pressurizing chamber 10, has the same height as the manifolds 5 and completely divides the manifolds 5 into a plurality of sub manifolds 5*b*. This ensures that the discharge hole 8 and the flow channel 13 extending from the discharge hole 8 to the pressurizing chamber 10 are disposed so as to be overlapped with the partition wall 15 in a plan view.

In FIG. 2, the entirety of the manifold 5 except for the opposite ends thereof is partitioned by the partition wall 15. Alternatively, the manifold 5 may be partitioned by the partition wall 15 except for one of the opposite ends. Still alternatively, only the vicinity of the opening 5*a* that opens on the upper surface of the flow channel member 4 may not be partitioned, and the partition wall extending from the opening 5*a* toward the depth direction of the flow channel member 4 may be disposed. In either case, owing to a nonpartitioned portion, the resistance of the flow channel is reduced so as to increase the amount of supply of the liquid. Hence, the opposite ends of the manifold 5 are preferably not partitioned by the partition wall 15.

The portions of the manifold 5, which are obtained by diving the manifold 5 into a plurality of pieces, are generally referred to as sub manifolds 5*b*. In the present embodiment, the two manifolds 5 are independently disposed and their opposite ends are respectively provided with the openings 5*a*. One of the two manifolds 5 includes seven partition walls 15 so as to be divided into eight sub manifolds 5*b*. The sub manifolds 5*b* have a larger width than the width of the partition wall 15, thus ensuring that a large amount of the liquid flows into the sub manifolds 5*b*. The seven partitions 15 have a longer length as approaching the center in the width direction, and the end of the partition wall 15 is closer to the end of the manifold 5 as the partition wall 15 becomes closer to the center in the width direction in the opposite ends of the manifold 5. This keeps a balance between a flow channel resistance to be caused by an outer wall of the manifold 5 and a flow channel resistance to be caused by the partition wall 15, thereby minimizing the difference in pressure of the liquid in the end of a region of each sub manifold 5*b* which is provided with an individual supply flow channel 14 that is the portion connected to the pressurizing chamber 10. The difference in pressure in the individual supply flow channel 14 leads to a difference in pressure applied to the liquid in the pressurizing chamber 10. Therefore, discharge variations can be reduced by minimizing the difference in pressure in the individual supply flow channel 14.

The flow channel member 4 is formed by a plurality of the two-dimensionally extended pressurizing chambers 10. Each of these pressurizing chambers 10 is a hollow region having an approximately rhombus or elliptical planar shape whose corners are rounded.

Each of the pressurizing chambers 10 is connected to the single sub manifold 5*b* via the individual supply flow channel 14. A pressurizing chamber row 11, which is the row of the pressurizing chambers 10 connected to this sub manifold 5*b*, is disposed one at each side of the sub manifold 5*b*, namely, a total of two rows thereof are disposed along the single sub manifold 5*b*. Accordingly, 16 rows of the pressurizing chambers 11 are disposed for the single manifold 5, and 32 pressuring chamber rows 11 are disposed in the entirety of the head body 2*a*. The interval of the pressurizing chambers 10 in the longitudinal direction thereof is the same, for example, 37.5 dpi, for all the pressurizing chamber rows 11.

A dummy pressurizing chamber 16 is disposed at the ends of each of the pressuring chamber rows 11. The dummy pressurizing chamber 16 is connected to the manifold 5, but not connected to the discharge hole 8. A dummy pressurizing chamber row in which the dummy pressurizing chambers 16 are disposed in a straight line shape is disposed outside the 32 pressurizing chamber rows 11. These dummy pressurizing chambers 16 are connected to neither the manifold 5 nor the discharge hole 8. Owing to these dummy pressurizing chambers 16, the structure (rigidity) of the circumference of the pressurizing chamber 10 located immediately next to and inside the end is approximated to the structure (rigidity) of other pressurizing chamber 10, thereby minimizing the difference in liquid discharge characteristics. The influence of the difference in the structure of the circumference is significant on the pressurizing chamber 10 that is located near and adjacent to in the length direction. Therefore, the dummy pressurizing chambers 16 are respectively disposed at opposite ends in the length direction. The influence is relatively slight in the width direction, and therefore, the dummy pressurizing chamber 16 is disposed on the side close to the end of the head body 21*a*. This contributes to a decrease in the width of the head body 21*a*.

The pressurizing chambers 10 connected to the single manifold 5 are disposed in a lattice shape made up of rows and columns respectively extending along the outer sides of the rectangular piezoelectric actuator substrate 21. This ensures that the individual electrodes 25 formed above the pressurizing chambers 10 are disposed at the same distance from the outer sides of the piezoelectric actuator substrate 21. Therefore, the piezoelectric actuator substrate 21 is less apt to deform when forming the individual electrodes 25. When the piezoelectric actuator substrate 21 and the flow channel member 4 are connected to each other in the presence of the significant deformation, a stress may be applied to the displacement devices 30 close to the outer sides, thus causing variations in displacement characteristics. However, the variations can be reduced by minimizing the deformation. Additionally, it is far less prone to the influence of the deformation because the dummy pressurizing chamber row of the dummy pressurizing chambers 16 is disposed outside the pressurizing chamber row 11 being closest to the outer sides. The pressurizing chambers 10 belonging to the pressurizing chamber row 11 are equally spaced, and the individual electrodes 25 corresponding to the pressurizing chamber row 11 are also equally spaced. The pressurizing chamber rows 11 are equally spaced in the lateral direction, and the individual electrodes 25 corresponding to the pressurizing chamber row 11 are also equally spaced in the lateral direction. These contribute to the elimination of the portions to be particularly severely influenced by crosstalk.

Although the pressurizing chambers 10 are disposed in the lattice shape in the present embodiment, they may be disposed in a staggered shape so that corner parts are located between the pressurizing chambers 10 belonging to the adjacent pressurizing chamber rows 11. This ensures a longer distance between the pressurizing chambers 10 belonging to the adjacent pressurizing chamber rows 11, thereby further suppressing the crosstalk.

The crosstalk is suppressible by making such an arrangement that the pressurizing chambers 10 belonging to the single pressurizing chamber row 11 are not overlapped with the pressurizing chambers 10 belonging to the adjacent pressurizing chamber row 11 in the longitudinal direction of the liquid discharge head 2 in the plan view of the flow channel member 4, regardless of how the pressurizing chamber rows 11 are disposed. Meanwhile, the width of the liquid discharged head 2 is increased with increasing the distance between the pressurizing chamber rows 11. Therefore, the accuracy of mounting angle of the liquid discharge head 2 with respect to the printer 1, and the accuracy of relative positions of a plurality of the liquid discharge heads 2 during their use may significantly affect the result of printing. The influence of these accuracies on the result of printing can be reduced by making the width of the partition wall 15 smaller than the sub manifold 5*b*.

The pressurizing chambers 10 connected to the single sub manifold 5*b* constitute two columns of the pressurizing chamber rows 11, and the discharge holes 8 connected from the pressurizing chambers 10 belonging to the single pressurizing chamber row 11 constitute a discharge hole row 9. The discharge holes 8 connected to the pressurizing chambers 10 belonging to the two columns of the pressurizing chamber rows 11 respectively open on different sides of the sub manifold 5*b*. In FIG. 4, the partition wall 15 is provided with the two discharge hole rows 9, and the discharge holes 8 belonging to each of the discharge hole rows 9 are connected via the pressurizing chambers 10 to the sub manifold 5*b* closer to the discharge holes 8. With such an arrangement that avoids overlapping with the discharge holes 8 connected via the pressuring chamber row 11 to the adjacent sub manifold 5*b* in the longitudinal direction of the liquid discharge head 2, it is possible to suppress the crosstalk between the flow channels connecting the pressurizing chambers 10 and the discharge holes 8, thereby further minimizing the crosstalk. The crosstalk can be further minimized with the arrangement made to avoid overlapping in the entirety of the flow channel connecting the pressurizing chambers 10 and the discharge holes 8 in the longitudinal direction of the liquid discharge head 2.

The width of the liquid discharge head 2 can be decreased by disposing so that the pressurizing chambers 10 and the sub manifolds 5*b* are overlapped with each other in the plan view. The width of the liquid discharge head 2 can be further decreased by ensuring that the proportion of an overlapping area with respect to the area of the pressurizing chambers 10 is 80% or more, preferably 90% or more. The bottom surface of the pressurizing chamber 10, corresponding to the portion in which the pressurizing chamber 10 and the sub manifold 5*b* are overlapped with each other, has lower rigidity than not being overlapped with the sub manifold 5*b*. The difference in rigidity may cause variations in discharge characteristics. The variations in discharge characteristics due to the change of rigidity of the bottom surface constituting each of the pressurizing chambers 10 can be minimized by ensuring that the pressurizing chambers 10 have an approximately identical ratio of the area of the pressurizing chamber 10 overlapped with the sub manifold 5*b* to the area of the entirety of the pressurizing chambers 10. The term "approximately identical" denotes that the difference in area ratio is 10% or less, particularly 5% or less.

A pressurizing chamber group is made up of a plurality of the pressurizing chambers 10 connected to the single manifold 5. There are the two manifolds 5, and hence there are two pressurizing chamber groups. The arrangement of the pressurizing chambers 10 involved in discharge is the same for these two pressuring chamber groups, and the arrangement is made by a parallel movement in the lateral direction. These pressurizing chambers 10 are disposed over approximately the entirety of a region of the upper surface of the flow channel member 4 which is opposed to the piezoelectric actuator substrate 21, though including portions having a slightly large clearance, such as space between the pressurizing chamber groups. That is, the pressurizing chamber groups made up of these pressurizing chambers 10 occupy a region having approximately the same shape as the piezoelectric actuator substrate 21. The openings of the pressurizing chambers 10 are closed with the arrangement that the piezoelectric actuator substrate 21 is connected to the upper surface of the flow channel member 4.

A flow channel 13 connected to the discharge hole 8 having an opening on the discharge hole surface 4-1 on the lower surface of the flow channel member 4 extends from the corner part opposed to the corner part of the pressurizing chamber 10 to which the individual supply flow channel 14 is connected. The flow channel 13 extends in a direction away from the pressurizing chamber 10 in the plan view. More specifically, the flow channel 13 departs in a direction along a long diagonal line of the pressurizing chamber 10, and also extends while being shifted to the left or right with respect to that direction. This ensures that the pressurizing chambers 10 are disposed in the lattice shape in which they are spaced at intervals of 37.5 dpi in each of the pressurizing chamber rows 11, and also ensures that the discharge holes 8 are spaced at intervals of 1200 dpi as a whole.

In other words, when the discharge holes 8 are projected so as to be orthogonal to a virtual straight line parallel to the longitudinal direction of the flow channel member 4, a total of 32 discharge holes 8 connected respectively 16 discharge holes to each of the manifolds 5 are disposed at equal intervals of 1200 dpi in a range R of the virtual straight line shown in FIG. 4. Accordingly, an image is formable at a resolution of 1200 dpi in the longitudinal direction as a whole by supplying an identical color ink to all the manifolds 5. The single discharge hole 8 connected to the single manifold 5 is disposed at equal intervals of 600 dpi in the range R of the virtual straight line. Accordingly, a bicolor image is formable at a resolution of 600 dpi in the longitudinal direction as a whole by supplying inks of different colors to each of the manifolds 5. In this case, a four-color image is formable at the resolution of 600 dpi by using the two liquid discharge heads 2. This ensures higher printing accuracy and an easier setting for the printing than using the liquid discharge head capable of printing at 600 dpi. The range R of the virtual straight line is covered with the discharge holes 8 connected from the pressurizing chambers 10 belonging to the single pressurizing chamber column disposed in the lateral direction of the head body 2*a*.

The individual electrodes 25 are respectively disposed at positions opposed to the pressurizing chambers 10 on the upper surface of the piezoelectric actuator substrate 21. Each of the individual electrodes 25 includes an individual electrode body 25*a* that is slightly smaller than the pressurizing chamber 10 and has a shape approximately similar to that of the pressurizing chamber 10, and an extraction electrode 25*b* extracted from the individual electrode body 25*a*. Similarly to the pressurizing chambers 10, the individual electrodes 25 constitute an individual electrode column and an individual electrode group. A surface electrode 28 for a common electrode electrically connected to a common electrode 24 with a via hole interposed therebetween is disposed on the upper surface of the piezoelectric actuator substrate 21. Two columns of the surface electrodes 28 for the common electrode are disposed in a middle part of the piezoelectric actuator substrate 21 in the lateral direction thereof so as to extend along the longitudinal direction, and a column of the surface electrodes 28 for the common electrode is disposed along the lateral direction in the vicinity of the end in the longitudinal direction. Although the shown surface electrodes 28 for the common electrode are intermittently formed on a straight line, they may be continuously formed on the straight line.

The piezoelectric actuator substrate 21 is preferably obtained as described later by laminating and firing a piezoelectric ceramic layer 21*a* having a via hole formed thereon, the common electrode 24, a piezoelectric ceramic layer 21*b*, followed by forming the individual electrodes 25 and the surface electrodes 28 for the common electrode in the same process. The individual electrodes 25 are formed after the firing because positional variations of the individual electrodes 25 and the pressurizing chambers 10 significantly affect the discharge characteristics, and because when the firing is carried out after forming the individual electrodes 25, the piezoelectric actuator substrates 21 may be subjected to warping, and when the warped piezoelectric actuator substrate 21 is connected to the flow channel member 4, the piezoelectric actuator substrate 21 is placed under stress, and the influence thereof may cause variations in displacement. The individual electrode 25 and the surface electrode 28 for the common electrode are formed in the same process because the surface electrode 28 for the common electrode may also cause warping, and because the simultaneous formation of the surface electrode 28 for the common electrode and the individual electrode 25 enhances positional accuracy and simplifies the process.

The positional variations of the via holes due to firing shrinkage, which can occur during the firing of the piezoelectric actuator substrate 21, occurs mainly in the longitudinal direction of the piezoelectric actuator substrate 21. Therefore, the surface electrode 28 for the common electrode is disposed in the middle of an even number of the manifolds 5, in other words, in the middle in the lateral direction of the piezoelectric actuator substrate 21. Moreover, the surface electrode 28 for the common electrode has such a shape that is long in the longitudinal direction of the piezoelectric actuator substrate 21. These make it possible to suppress an electrical disconnection due to misalignment between the via hole and the surface electrode 28 for the common electrode.

The two signal transmission sections 92 are disposed on and connected to the piezoelectric actuator substrate 21 so as to respectively extend from the two long sides of the piezoelectric actuator substrate 21 toward the middle thereof. On that occasion, a connection electrode 26 and a connection electrode for the common electrode are respectively formed on and connected to the extraction electrode 25*b* and the surface electrode 28 for the common electrode of the piezoelectric actuator substrate 21, thus facilitating the connection. Additionally, on that occasion, the area of the surface electrode 28 for the common electrode and the area of the connection electrode for the common electrode are made larger than the area of the connection electrode 26. Consequently, the connections at the ends of the signal transmission section 92 (the front end and the end in the longitudinal direction of the piezoelectric actuator substrate 21) can be enhanced by the connection on the surface electrode 28 for the common electrode, thus ensuring that the signal transmission section 92 is less apt to be peeled off from the end thereof.

The discharge holes 8 are disposed at locations except a region opposed to the manifolds 5 disposed on the lower surface of the flow channel member 4. The discharge holes 8 are also disposed in a region on the lower surface of the flow channel member 4 which is opposed to the piezoelectric actuator substrate 21. These discharge holes 8 occupy, as a group, the region having approximately the same shape as the piezoelectric actuator substrate 21. The liquid drops are dischargeable from the discharge holes 8 by displacing the displacement elements 30 of the corresponding piezoelectric actuator substrate 21.

The flow channel member 4 included in the head body 2*a* has a laminate structure having a plurality of plates laminated one upon another. These plates are a cavity plate 4*a*, a base plate 4*b*, an aperture plate 4*c*, a supply plate 4*d*, manifold plates 4*e* to 4*j*, a cover plate 4*k*, and a nozzle plate 41 in descending order from the upper surface of the flow channel member 4. A large number of holes are formed in these plates. These plates respectively have a thickness of approximately 10 to 300 μm, thus enhancing the forming accuracy of the holes to be formed. These plates are aligned and laminated so that these holes communicate with each other to constitute the individual flow channels 12 and the manifolds 5. The pressurizing chambers 10 are disposed on the upper surface of the flow channel member 4, the manifolds 5 are disposed on the lower surface inside the flow channel member 4, and the discharge holes 8 are disposed on the lower surface of the flow channel member 4. Accordingly, the parts constituting the individual flow channel 12 are disposed close to each other at different positions, and the manifolds 5 and the discharge holes 8 are connected to the head body 2*a* via the pressurizing chambers 10.

The holes formed in the foregoing plates are described below. These holes can be classified into the following ones. Firstly, there is the pressurizing chamber 10 formed in the cavity plate 4*a*. Secondly, there is a communication hole constituting the individual supply flow channel 14 connected from one end of the pressurizing chamber 10 to the manifold 5. This communication hole is formed in each of the plates, from the base plate 4*b* (specifically, an inlet of the pressurizing chamber 10) to the supply plate 4*c* (specifically, an outlet of the manifold 5). The individual supply flow channel 14 includes the aperture 6 that is formed on the aperture plate 4*c* and is a portion having a small cross-sectional area of the flow channel.

Thirdly, there is a communication hole that constitutes a flow channel 13 communicating from the other end of the pressurizing chamber 10 to the discharge hole 8. The flow channel 13 is made up of a nozzle part 13*a* whose cross section is narrowed near the discharge hole 8, and a partial flow channel (descender) 13*b* excluding the nozzle part 13*a*. The flow channel 13 is formed in each of the plates, from the base plate 4*b* (specifically, an outlet of the pressurizing chamber 10) to the nozzle plate 41 (specifically, the discharge hole 8). The nozzle part 13*a* is formed on the nozzle plate 41. The nozzle part 13*a* has a hole with a diameter of, for example, 10 to 40 μm, which opens on the exterior of the flow channel member 4 as the discharge hole 8, and the diameter increases toward the interior. An inner wall of the nozzle part 13*a* is tilted at 10 to 30 degrees. The partial flow channel 13*b* is a sequence of holes having no significant difference in diameter, namely, having a diameter of approximately 50 to 200 μm. That is, the ratio of a minimum diameter to a maximum diameter is approximately two times.

Fourthly, there is a communication hole constituting the manifold 5. This communication hole is formed in the manifold plates 4*e* to 4*j*. The hole is formed in each of the manifold plates 4*e* to 4*j* so that a partition region serving as the partition wall 15 remains so as to constitute the sub manifold 5*b*. This ensures a state in which the partition region in the manifold plates 4*e* to 4*j* are respectively connected to the manifold plates 4*e* to 4*j* by a half-etched support part 17.

The first to fourth communication holes are connected to each other to form the individual flow channel 12 that extends from the inlet for the liquid from the manifold 5 (the outlet of the manifold 5) to the discharge hole 8. The liquid supplied to the manifold 5 is discharged from the discharge hole 8 through the following route. Firstly, the liquid proceeds upward from the manifold 5, and passes through the individual supply flow channel 14 to one end of the aperture 6. The liquid then proceeds in a planar direction along the extending direction of the aperture 6 and reaches the other end of the aperture 6. The liquid then proceeds upward from there and reaches one end of the pressurizing chamber 10. Further, the liquid proceeds in the planar direction along the extending direction of the pressurizing chamber 10 and reaches the other end of the pressurizing chamber 10. The liquid flowing from the pressurizing chamber 10 into the partial flow channel 13 moves in the planar direction while flowing downward. The movement in the planar direction is large at the beginning and becomes small near the discharge hole 8. The liquid proceeds from an end of the partial flow channel 13*b* and passes through the nozzle part 13 having the small diameter to the discharge hole 8 that opens on the lower surface, thus being discharged.

In FIG. 3, the hole of the aperture plate 4*c* including a portion serving as the aperture 6 (hereinafter referred to generally as the hole serving as the aperture) is slightly overlapped with another pressurizing chamber 10 connected from the same sub manifold 5*b*. The hole of the aperture plate 4*c* including the portion serving as the aperture 6 is preferably disposed so as to be included in the sub manifold 5*b* in the plan view, thus allowing the aperture 6 to be disposed more densely. In this manner, however, the entire hole serving as the aperture 6 is to be disposed in a region on the sub manifold 5*b* which has a smaller thickness than other region, thus being susceptible to influence from the circumference. In such occasions, it is necessary to ensure that the hole serving as the aperture 6 is not overlapped with the pressurizing chamber 10 other than the pressurizing chamber 10 that is directly connected to the hole in the plan view. Consequently, even when the hole serving as the aperture 6 is disposed in the thin region on the sub manifold 5*b*, the aperture 6 is less subjected to the direct influence of vibrations from other pressurizing chamber 10 disposed immediately thereabove. This configuration is particularly required when the vibration is apt to be transmitted due to a single plate interposed between the plate including the hole serving the aperture 6 (when constituted by a plurality of plates, the uppermost plate among these) and the plate including the hole serving as the pressurizing chamber 10 (when constituted by a plurality of plates, the lowermost plate among these). This configuration is also particularly required when the distance between the plate including the hole serving as the aperture 6 and the plate including the hole serving as the pressurizing chamber 10 is 200 μm or less, particularly 100 μm or less. The configuration for avoiding the overlap is obtainable by, for example, approximating the angle of the hole serving as the aperture 6, which is shown in FIG. 3, to a direction along the lateral direction of the head body 2*a*, or by slightly shortening one end of the hole serving as the aperture 6.

The piezoelectric actuator substrate 21 has a laminate structure made up of two piezoelectric ceramic layers 21*a* and 21*b* that are piezoelectric bodies. Each of these piezoelectric ceramic layers 21*a* and 21*b* has a thickness of approximately 20 μm. The thickness from the lower surface of the piezoelectric ceramic layer 21*a* to the upper surface of the piezoelectric ceramic layer 21*b* in the piezoelectric actuator substrate 21 is approximately 40 μm. Both the piezoelectric ceramic layers 21*a* and 21*b* extend across a plurality of the pressurizing chambers 10. These piezoelectric ceramic layers 21*a* and 21*b* are composed of, for example, ferroelectric lead zirconate titanate (PZT) based ceramic material.

Each of the piezoelectric actuator substrates 21 includes a common electrode 24 composed of, for example, an Ag—Pd based metal material, and the individual electrode 25 composed of, for example, an Au based metal material. As described above, the individual electrode 25 includes the individual electrode body 25*a* disposed at the position opposed to the pressurizing chamber 10 on the upper surface of the piezoelectric actuator substrate 21, and the extraction electrode 25*b* extracted from the individual electrode body 25*a*. The connection electrode 26 is formed at a portion of one end of the extraction electrode 25*b* which is extracted to the outside of the region opposed to the pressurizing chamber 10. The connection electrode 26 is composed of, for example, silver-palladium containing glass frit, and is convexly formed with a thickness of approximately 15 μm. The connection electrode 26 is electrically connected to the electrode disposed on the signal transmission section 92. Although the details thereof are described later, a driving signal is supplied from the control section 100 via the signal transmission section 92 to the individual electrode 25. The driving signal is supplied on a constant period in synchronization with a transport speed of a printing medium P.

The common electrode 24 is formed over approximately the entire surface in the planar direction in a region between the piezoelectric ceramic layer 21*a* and the piezoelectric ceramic layer 21*b*. That is, the common electrode 24 extends to cover all the pressurizing chambers 10 in the region opposed to the piezoelectric actuator substrate 21. The thickness of the common electrode 24 is approximately 2 μm. The common electrode 24 is connected through the via hole formed in the piezoelectric ceramic layer 21*b* to the surface electrode 28 for the common electrode which is formed at the position away from the electrode group made up of the individual electrodes 25 on the piezoelectric ceramic layer 21*b*, and is grounded and held at ground potential. Similarly to the large number of individual electrodes 25, the surface electrode 28 for the common electrode is connected to other electrode on the signal transmission section 92.

As described later, a predetermined driving signal is selectively supplied to the individual electrode 25 so as to change the volume of the pressurizing chamber 10 corresponding to the individual electrode 25, thereby applying a pressure to the liquid in the pressurizing chamber 10. Consequently, the liquid drops are discharged from the corresponding discharge hole 8 through the individual flow channel 12. That is, the part of the piezoelectric actuator substrate 21 which is opposed to the pressurizing chamber 10 corresponds to the displacement element 30 corresponding to the pressurizing chamber 10 and the discharge hole 8. Specifically, the displacement element 30 that is the piezoelectric actuator, whose unit structure is the structure as shown in FIG. 5, is fabricated in units of the pressurizing chamber 10 into a laminate body made up of the two piezoelectric ceramic layers 21*a* and 21*b* by using the vibrating plate 21*a*, the common electrode 24, the piezoelectric ceramic layer 21*b*, and the individual electrode 25, each of which is located immediately above the pressurizing chamber 10. The piezoelectric actuator substrate 21 includes a plurality of the displacement elements 30 that are pressurizing parts. In the present embodiment, the amount of the liquid discharged from the discharge hole 8 by a single discharge operation is approximately 1.5 to 4.5 pl (pico litter).

The large number of individual electrodes 25 are individually electrically connected to the control section 100 via the signal transmission section 92 and a wire so as to ensure an individual control of potential. When the individual electrode 25 is set to a potential different from that of the common electrode 24 and an electric field is applied to the piezoelectric ceramic layer 21*b* in the polarization direction thereof, the region subjected to the application of the electric field serves as an active part that is warped by piezoelectric effect. When in this configuration the individual electrode 25 is set to a positive or negative predetermined potential with respect to the common electrode 24 by the control section 100 so that the electric field and the polarization are oriented in the same direction, the part (active part) held between the electrodes of the piezoelectric ceramic layer 21*b* contracts in the planar direction. On the other hand, the piezoelectric ceramic layer 21*a* that is a non-active layer is not affected by the electric field, and therefore does not contract spontaneously, but attempts to restrict the deformation of the active part. This creates a difference in warping in the polarization direction between the piezoelectric ceramic layer 21*b* and the piezoelectric ceramic layer 21*a*. Consequently, the piezoelectric ceramic layer 21*b* is deformed so as to be protruded toward the pressurizing chamber 10 (unimorph deformation).

According to an actual driving procedure in the present embodiment, the individual electrode 25 is previously set at a higher potential than that of the common electrode 24 (hereinafter referred to as a high potential), and the individual electrode 25 is temporarily set at the same potential as the common electrode 24 (hereinafter referred to as a low potential) every time a discharge request is made, and thereafter is set again at the high potential at a predetermined timing. This ensures that the piezoelectric ceramic layers 21*a* and 21*b* return to their original shape at the timing that the individual electrode 25 has the low potential, and the volume of the pressurizing chamber 10 is increased compared to the initial state thereof (the state that the potentials of both electrodes are different from each other). On that occasion, a negative pressure is applied to the inside of the pressurizing chamber 10, and the liquid is absorbed through the manifold 5 into the pressurizing chamber 10. Thereafter, at the timing that the individual electrode 25 is set again at the high potential, the piezoelectric ceramic layers 21*a* and 21*b* are deformed projectedly toward the pressurizing chamber 10. Then, the pressure inside the pressurizing chamber 10 becomes a positive pressure due to the reduced volume of the pressurizing chamber 10, and hence the pressure applied to the liquid is increased to discharge the liquid drops. That is, a driving signal containing pulses on the basis of the high potential is to be supplied to the individual electrode 25 for the purpose of discharging the liquid drops. An ideal pulse width is an AL (acoustic length) that is a length of time during which a pressure wave propagates from the aperture 6 to the discharge hole 8. This ensures that when a negative pressure state is reversed to a positive pressure state in the pressurizing chamber 10, both pressures are combined together to allow the liquid drops to be discharged under a stronger pressure.

In a gradation printing, a gradation expression is made by the number of liquid drops to be continuously discharged from the discharge hole 8, namely, the amount of liquid drops (volume) to be adjusted by the number of discharges of liquid drops. Therefore, the discharges of liquid drops, the number of which corresponds to a designated gradation expression, are continuously performed from the discharge hole 8 corresponding to a designated dot region. In general, when the discharge is performed continuously, an interval between one pulse and another to be supplied for discharging the liquid drops is preferably set to "AL". This ensures that the cycle of a residual pressure wave of the pressure generated when discharging an early discharged liquid drop corresponds to the cycle of a pressure wave of the pressure generated when discharging a later discharged liquid drop, and both are superimposed to amplify the pressure for discharging the liquid drops. In this case, the speed of the later discharged liquid drop seems to increase, however, this is preferred because landing points of a plurality of liquid drops become closer to each other.

In the present embodiment, the displacement element 30 using piezoelectric deformation is described as the pressurizing part, without limitation thereto. Another one which is capable of changing the volume of the pressurizing chamber 10, namely, pressurizing the liquid in the pressurizing chamber 10 may be employed. For example, one which is configured to heat and boil the liquid in the pressurizing chamber 10 so as to generate a pressure, or one using MEMS (micro electro mechanical systems) may be employed.

The shape of the partial flow channel 13 in the liquid discharge head 2 is further described in detail. On the discharge hole rows 9, the discharge holes 8 are equally spaced along the longitudinal direction of the manifold 5 and the head body 2*a*. The discharge holes 8 of each of the discharge hole rows 9 are disposed by being gradually shifted in the longitudinal direction of the head body 2*a*. On the other hand, the pressurizing chambers 10 are disposed in the lattice shape in the present embodiment. Besides the lattice shape, a staggered arrangement may be employed as the arrangement of the pressurizing chambers 10. The pressurizing chambers 10 are respectively arranged in regular distance and direction with respect to the surrounding pressurizing chambers 10. With this configuration, it is possible to avoid that due to a large difference in the arrangement of the pressurizing chambers 10 and the arrangement of the surrounding pressurizing chamber 10, the pressurizing chambers 10 are different from one another in surrounding rigidity and in the influence of crosstalk exerted from the surrounding pressurizing chambers 10. This makes it possible to minimize the difference in discharge characteristics.

However, it is difficult to match the arrangement of the pressurizing chambers 10 with the arrangement of the discharge holes 8. Therefore, the flow channel 13 extending from the pressurizing chamber 10 to the discharge hole 8 is required not only to extend from the pressurizing chamber surface 4-2 to the discharge hole surface 4-1 but also move in the planar direction parallel to the discharge hole surface 4-1. When the amount of movement in the planar direction is increased, the influence thereof appears in a discharge direction. Specifically, with a large amount of movement in the planar direction in the partial flow channel 13*b*, the discharge direction is shifted from a direction orthogonal to the discharge hole surface 4-1 to the movement direction. Although the discharge direction is not necessarily the direction orthogonal to the discharge hole surface 4-1, the liquid discharge head 2 is usually designed to be so used. When all the discharge holes 8 are subjected to a deviation of the discharge direction, their landing positions are misaligned, resulting in low printing accuracy.

Although the principle of the deviation of the discharge direction is not clarified in detail, it seems that the liquid in the partial flow channel 13*b* proceeds obliquely with respect to the discharge hole surface 4-1, and the liquid is discharged as it is in an oblique direction. The nozzle plate 41 incudes the nozzle part 13*a* having rotational symmetry with respect to a line orthogonal to the discharge hole surface 4-1, and hence the liquid passing therethrough is basically guided in the direction orthogonal to the discharge hole surface 4-1. It also seems that if the liquid is discharged as it is merely in the direction in which the liquid proceeds in the partial flow channel 13*b*, the discharge direction approximately corresponds to the angle of the partial flow channel 13*b*. However, the actual deviation in the discharge direction is smaller. For example, even when the partial flow channel 13*b* is tilted at 20 degrees or more, the deviation of landing position is approximately 2 μm and the tilt of the discharge direction is approximately 0.03 degrees after the liquid drop is blown off by 1 mm.

The tilt of the discharge direction seems to be caused by the following phenomena. That is, the shape of a surface when a meniscus formed in the nozzle part 13*a* approaches the discharge hole 8 is deviated from a point symmetrical state and hence is slightly oblique, and the speed of the liquid when passing through the nozzle part 13*a* is slightly different depending on the position of the inner wall of the nozzle part 13*a*, and a tail cutting position when the tail of the discharged liquid drop is cut is deviated from the center of the nozzle part 13*a*. These lead to the behavior of the liquid that a motion component in the lateral direction is added when the tail catches up with a liquid drop body. Irrespective of the cause, the influence thereof can be minimized by decreasing the tilt of the partial flow channel 13*b*. However, the movement distance in the planar direction is determined by the arrangement of the pressurizing chambers 10 and the arrangement of the discharge holes 8 as described above, and hence it is difficult to adjust the movement distance. By increasing the length of the partial flow channel 13*b*, the tilt is decreased whereas the AL is increased, thus creating disadvantages, such as unsuitability for high frequency drive.

Therefore, the deviation of the discharge direction can be minimized by configuring so that a fixed length region of the partial flow channel 13*b* which is close to the nozzle part 13*a* has an approximately straight shape parallel to the direction orthogonal to the discharge hole surface 4-1, and the movement in the planar direction is approximately terminated in a region close to the pressurizing chamber 10.

A specific shape is described with reference to FIG. 6. The partial flow channel 13*b* is formed by connecting the holes formed on the plates 4*b* to 4*k* to one another. These holes are formed by etching, and hence have such a shape that a spherical shape formed from the front surface and a spherical shape formed from the rear surface are engaged with each other. The cross sectional area of the partial flow channel 13*b* is decreased in the vicinity of the center in the thickness direction of the plates 4*b* to 4*k*. A misalignment occurs between the center of etching from the front surface and the center of etching from the rear surface, and hence a dislocation between the plates occurs so as to move in the planar direction, as well as to move in the planar direction within the plates.

Although the front surface and rear surface of each of these holes have a circular shape, both surfaces may have a rectangular shape approximating a square shape or elliptical shape. The overall shape of each hole is approximately a columnar shape or tilted columnar shape, and specifically the shape obtained by combining the two spheres as described above.

"W [μm]" is a mean diameter of the partial flow channel 13*b* (specifically, a diameter of a cross section parallel to the discharge hole surface 4-1). When the cross sectional shape is not the circular shape, the diameter of a circle having the same area may be used as the diameter. More specifically, a cross sectional area may be calculated by dividing the volume ($\mu m^3$) of the partial flow channel 13*b* by a length L [μm] of the partial flow channel 13*b* in the direction orthogonal to the discharge hole surface 4-1. The value of the diameter [μm] of the circle having an area equal to the cross sectional area may be used as W. Here, W is for mainly determining the shape of the side of the partial flow channel 13*b* which is close to the nozzle part 13*a*. Therefore, when the partial flow channel 13*b* is formed by connecting holes having significantly different cross sectional areas (for example, when there is two times or more difference in diameter and there is four times or more difference in cross sectional area), an opening diameter of the end close to the nozzle part 13*a* may be used.

"C1" is an area centroid of a cross sectional shape on a plane P1 on the end of the partial flow channel 13*b* close to the nozzle part 13*a*, which is parallel to the discharge hole surface 4-1. The opening of the side of the nozzle part 13*a* which is close to the partial flow channel 13*b* is disposed so that C1 is included in the opening in the plan view. "C2" is an area centroid of a cross sectional shape on a plane P2, which is located 2 W upwardly away from the end of the partial flow channel 13*b* close to the nozzle part 13*a* in the direction orthogonal to the discharge hole surface 4-1, and which is parallel to the discharge hole surface 4-1. "C3" is an area centroid of a cross sectional shape on a plane P3 of the end of the partial flow channel 13*b* close to the pressurizing chamber 10, which is parallel to the discharge hole surface 4-1.

The liquid in the partial flow channel 13*b* flows from C3 to C1 via C2. There is a misalignment between the openings on the plates, and there is also a misalignment between the openings of the front and rear of the plates so as to ensure that the liquid flows downward from C3 to C2 and the movement in the planar direction is increased.

The distance between C2 and C1 in the direction parallel to the discharge hole surface 4-1 is D2 [μm], and D2≤0.1 W. The partial flow channel 13*b* in the range of 2 W from the nozzle part 13*a*, which has a strong influence on the discharge direction, has such a shape that is approximately orthogonal to the discharge hole surface 4-1, and the discharge direction is approximate to the direction orthogonal to the discharge hole surface 4-1. The partial flow channel 13*b* includes a portion having a shape being obliquely connected between C3 and C2. Therefore, it seems that a pressure wave is brought into a disordered state under the influence of the shape, but is reconfigured into a pressure wave approximately parallel to the discharge hole surface 4-1 owing to scattering on the inner wall while the pressure wave proceeds by a length that is twice as long as the opening diameter W so as to approach C1.

"Cm" is an intersection of a straight line C1C3 connecting C1 and C3, and the plane P2 parallel to the discharge hole surface located 2 W away from the end close to the nozzle part 13*a* in the direction orthogonal to the discharge hole surface 4-1. In other words, when a partial flow channel 13*b* having a shape connecting linearly C1 and C3 is produced, Cm is the position at which the center of the partial flow channel 13*b* passes through the plane P2. The distance between Cm and C1 in the direction parallel to the discharge hole surface 4-1 is Dm [μm]. Under the condition that Dm>0.1 W, C3 and C1 are connectable even when there is a long distance between C3 and C1 in the planar direction. Although FIG. 6 shows the case where C1, C2, and C3 are on a longitudinal section, they may not necessarily be so.

When a narrow portion 13*ba* is disposed in a range located 2 W away from the end of the partial flow channel 13*b* which is close to the nozzle part 13*a* in the direction orthogonal to the discharge hole surface 4-1, the pressure wave is to be collected in the vicinity of the center of the partial flow channel 13*b* by the narrow portion 13*ba*. Therefore, the disorder of the pressure wave caused in the vicinity of C2 is adjusted, making it easier to then become a pressure parallel to the discharge hole surface 4-1. The diameter of the narrow portion 13*ba* is preferably 0.5 W to 0.9 W, more preferably 0.6 W to 0.8 W. This eliminates the possibility that due to an excessively small diameter, the resistance increases and the discharge speed decreases extremely, or the diameter is too large to satisfactorily produce the effect obtained from the narrow portion 13*ba*.

Figure 7:
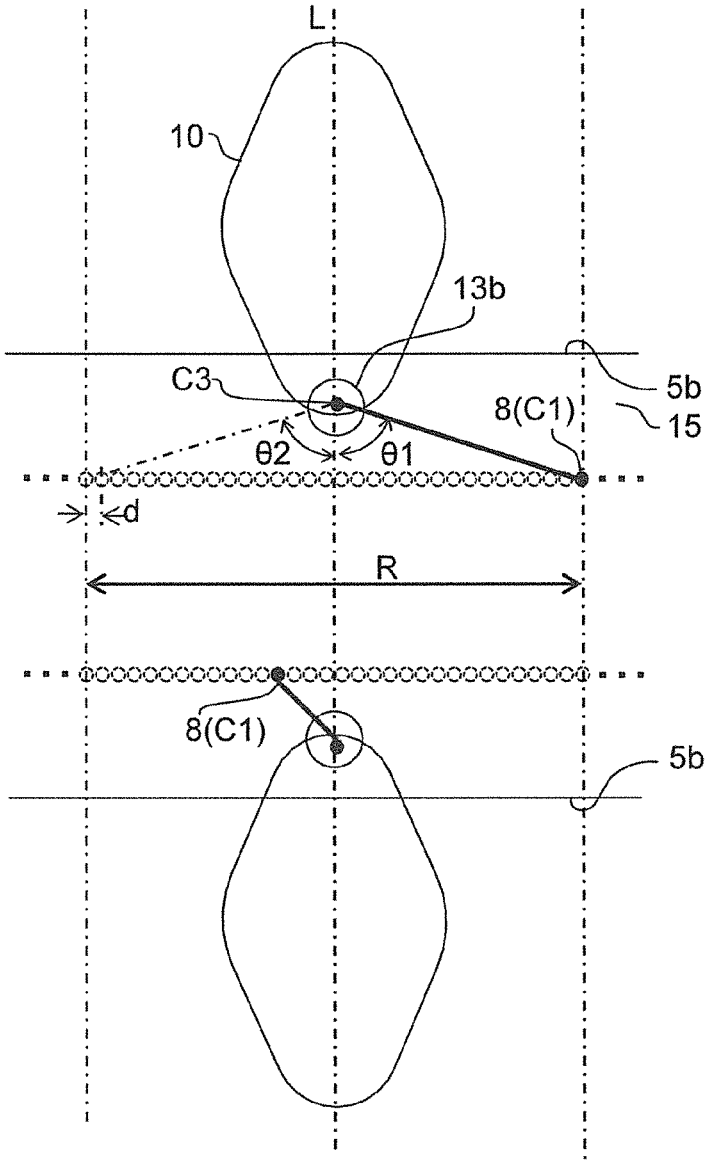
FIG. 7 is a partially enlarged cross sectional view of FIG. 4.

The liquid discharge head 2 having such a shape that a range of 2 W from C1 is approximately orthogonal to the discharge hole surface 4-1 is particularly useful when the angle formed by a straight line connecting the discharge hole 8 (more accurately, an area centroid Cn of the opening of the discharge hole 8 on the discharge hole surface 4-1) and C3, and a column direction is large in the plan view. This is described with reference to FIG. 7. FIG. 7 is a plan view showing in enlarged dimension a part of FIG. 4, and showing the two pressurizing chambers 10 and the partition wall 15 disposed therebetween. A total of 32 pressurizing chambers 10, including unshown ones, are disposed on a virtual straight line L shown in FIG. 7. Two discharge holes 8, both of which are respectively connected to the shown two pressurizing chambers 10, are indicated by a black point, and relative positions of the discharge holes 8 connected to other unshown pressurizing chambers 10 with respect to the pressurizing chambers 10 are indicated by a chain-line circle. The discharge holes 8 connected to the 32 pressurizing chambers 10 disposed on the virtual straight line L are disposed at equal intervals d [μm] in the range R as shown in the drawing.

In FIG. 7, the relative positions of the 32 discharge holes 8 are shown on the lower side of the pressurizing chambers 10 located on the upper side of the drawing, and the relative positions of the 32 discharge holes 8 are shown on the upper side of the pressurizing chambers 10 located on the lower side of the drawing. Actually, the discharge holes 8 underlying the pressurizing chambers 10 correspond to 16 of the shown 32 relative positions, and the discharge holes 8 overlying the pressurizing chambers 10 correspond to 16 of the shown 32 relative positions. To be accurate, a total of 32 discharge holes 8 obtained by adding each of the 16 discharge holes 8 are disposed at the equal intervals d [μm] in the range R.

Although omitted in the drawing, the discharge holes 8 connected to the pressurizing chamber columns adjacent to each other in the row direction are disposed continuously on the left and right sides in the drawing. The partial flow channels 13*b* are almost omitted, and there are shown only the portions directly contacted with the pressurizing chambers 10. In place of these, a line connecting C3 and Cn is shown.

Consideration is given here to an angle θ formed by the line connecting C3 and Cn and the column direction. In the drawing, a maximum value of the angle θ to be formed when Cn proceeds rightward in the drawing is indicated by θ1, and a maximum value of the angle θ to be formed when Cn proceeds leftward in the drawing is indicated by θ2. When designing the liquid discharge head 2 capable of printing at a desired resolution, the angles θ1 and θ2 to be formed by the line connecting C3 and Cn and the column direction are preferably small in consideration of only the accuracy of the discharge direction of the liquid (accuracy of the landing position) in the normal liquid discharge head 2 (the liquid discharge head 2 in which the partial flow channel 13*b* in the vicinity of the discharge hole surface 4-1 is not approximately orthogonal to the discharge hole surface 4-1). However, d [μm] is the value that indicates the distance of adjacent pixels (resolution) in a basic use. Therefore, when designing the liquid discharge head 2 capable of printing at the desired resolution, d [μm] is an unchangeable value. When attempting to reduce θ1 and θ2 while setting d [μm] to a fixed value, the length of the straight line connecting C3 and Cn is increased (the length of the partial flow channel 13*b* is greater than or equal to that), and the length of the liquid discharge head 2 is increased in the lateral direction thereof. This is not preferable because the mounting angle of the liquid discharge head 2 significantly affects the printing accuracy.

Increasing the length of the partial flow channel 13*b* elongates the inherent vibrational period of the liquid in the partial flow channel 13*b* and the pressurizing chamber 10. The length of a drive waveform is proportional to the inherent vibrational period, and hence the length of the drive waveform required per discharge becomes elongated. Therefore, when attempting to drive at a high drive frequency, the drive waveform may not fall within a single drive period, thus being unsuitable for the drive at the high frequency (high speed printing).

When θ1 and θ2 are 45 degrees or more in the normal liquid discharge head 2, the angle significantly affects the variations in the row direction in the discharge direction, resulting in poor printing accuracy. However, as long as the partial flow channel 13*b* in the vicinity of the discharge hole surface 4-1 is approximately orthogonal to the discharge hole surface 4-1 as in the present embodiment, the printing accuracy is hardly deteriorated even when θ1 and θ2 are 45 degrees or more. Therefore, even when θ1 and θ2 are set to 45 degrees or more, it is possible to decrease the length in the lateral direction so as to produce the liquid discharge head 2 for a high drive frequency without deteriorating the printing accuracy. With the liquid discharge head 2 of the present invention, in order to take advantage of the above, it is rather preferable to increase θ1 and θ2, preferably 60 degrees or more, more preferably 75 degrees or more.

In the movement from C3 to C2 in the planar direction, the deviation in the openings between the plates is reduced to W/3 or less so as to suppress lowering of the discharge speed due to that the partial flow channel 13*b* is narrowed between the plates. Moreover, by reducing the deviation in the openings between the plates to W/4 or less, it is possible to suppress the possibility that the partial flow channel 13*b* is narrowed between the plates and the etching on the front side and the etching on the rear side are not connected to each other in the plates.

For example, when there is such a restriction in the design from C3 to C2, there is the possibility that the movement distance in the planar direction necessary for connecting the pressurizing chamber 10 and the discharge hole 8 cannot be ensured. In that case, the shape of the pressurizing chamber 10 needs to have a shape obtained by being rotated in the discharge hole surface 4-2. This is described with reference to FIG. 8.

Figure 8:
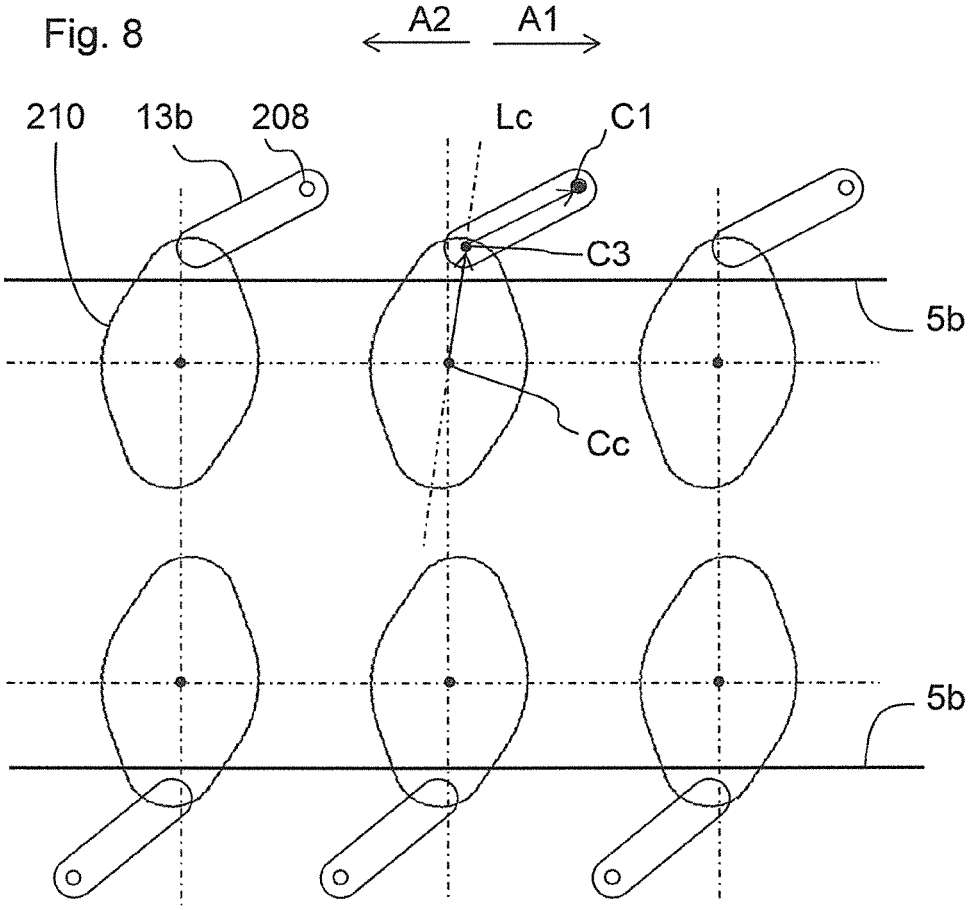
FIG. 8 is an enlarged plan view of a liquid discharge head according to other embodiment of the present invention.

FIG. 8 is an schematic enlarged plan view of the head body. In FIG. 8, partial flow channels 213*b*, which are actually formed by connecting holes having a circular cross section, are shown by a schematic shape obtained by connecting the partial flow channels 213*b*. The basic structure of the head body is approximately identical to those shown in FIGS. 2 to 6, and differences therebetween are described below. "Cc" is an area centroid of the pressurizing chamber 210, and the area centroids Cc of the pressurizing chambers 210 are disposed in the lattice shape similarly to the head body 2*a*. The pressurizing chambers 210 have a rhombus shape, and a long axis Lc connecting their narrow angles has an angle that is not zero degree with respect to the lattice-shaped arrangement of the pressurizing chambers 210. This angle is such a rotational angle that the rhombus-shaped pressurizing chamber 210 is rotated in the planar direction. The rotational angle in the pressurizing chamber 210 connected to the partial flow channel 213*b* having a large movement distance in the planar direction is imparted so as to assist the movement in the planar direction in the partial flow channel 213*b*.

"A1" is one of the directions in which the pressurizing chambers 210 are connected to one another, and "A2" is the opposite direction. Irrespective of whether the discharge hole 8 connected to the pressurizing chamber 210 is located on the side of A1 direction or A2 direction with respect to the area centroid Cc of the pressurizing chamber 210, it is necessary to connect therebetween by the flow channel. When the movement distance to the discharge hole 8 in A1 direction is large, the discharge direction forms an angle with respect to the direction orthogonal to the discharge hole surface by employing a partial flow channel 213 that linearly connects C1 and C3. Therefore, a region of the partial flow channel 213*b* which is close to the nozzle part and has a length 2 W is made into a shape oriented to the direction approximately orthogonal to the discharge hole surface, and the movement in the planar direction in the partial flow channel 213*b* is to be made between C3 and C2 (not shown).

In the pressurizing chambers 210 on the row located on the upper side in FIG. 8, the direction being directed from C3 to C1 is oriented to A1 direction. The pressurizing chambers 210 on the line have a shape obtained by being rotated in the planar direction, and the direction being directed from Cc to C3 of the partial flow channel 213*b* connected to an end of the pressurizing chamber 210 is also oriented to the direction of A1. This ensures the connection between the pressurizing chamber 210 and the discharge hole 8 even when the movement distance is large. This is also true for the case where the discharge hole 8 is located close to A2 with respect to the pressurizing chamber 210 and the movement distance is large, as in the pressurizing chamber 210 on the row located on the lower side in FIG. 8. In either case, even when the movement distance is large, the connection between the pressurizing chamber 210 and the discharge hole 8 is ensured under the condition that the direction being directed from C3 to C1 and the direction being directed from Cc to C3 are in agreement on whether to be oriented to the direction of A1 or the direction of A2.

More specifically, in the pressurizing chamber 210 connected to the partial flow channel 213*b* satisfying the condition that the distance between Cm and C1 in the direction parallel to the discharge hole surface (the definition of C1, C2, and Cm is the same as described above) is larger than 0.1 W, and the distance between C2 and C1 in the direction parallel to the discharge hole surface is 0.1 W or less, the direction being directed from the area centroid Cc of the planar shape of the pressurizing chamber 210 to C3 of the partial flow channel 213*b*, and the direction being from C3 of the partial flow channel 213*c* to C1 need to be in agreement on whether to be oriented to the direction of A1 that is one of the directions in which the discharge holes 8 or the pressurizing chambers 210 are disposed continuously, or whether to be oriented to the opposite direction, namely, the direction of A2. In the pressurizing chambers 210 connected to the partial flow channel 213*b* not satisfying the foregoing condition, the agreement on the direction may not be required. However, by ensuring the agreement on the direction, the movement distance in the planar direction in the partial flow channel 213*b* can be decreased so as to further minimize the deviation of the discharge direction.

Figure 11:
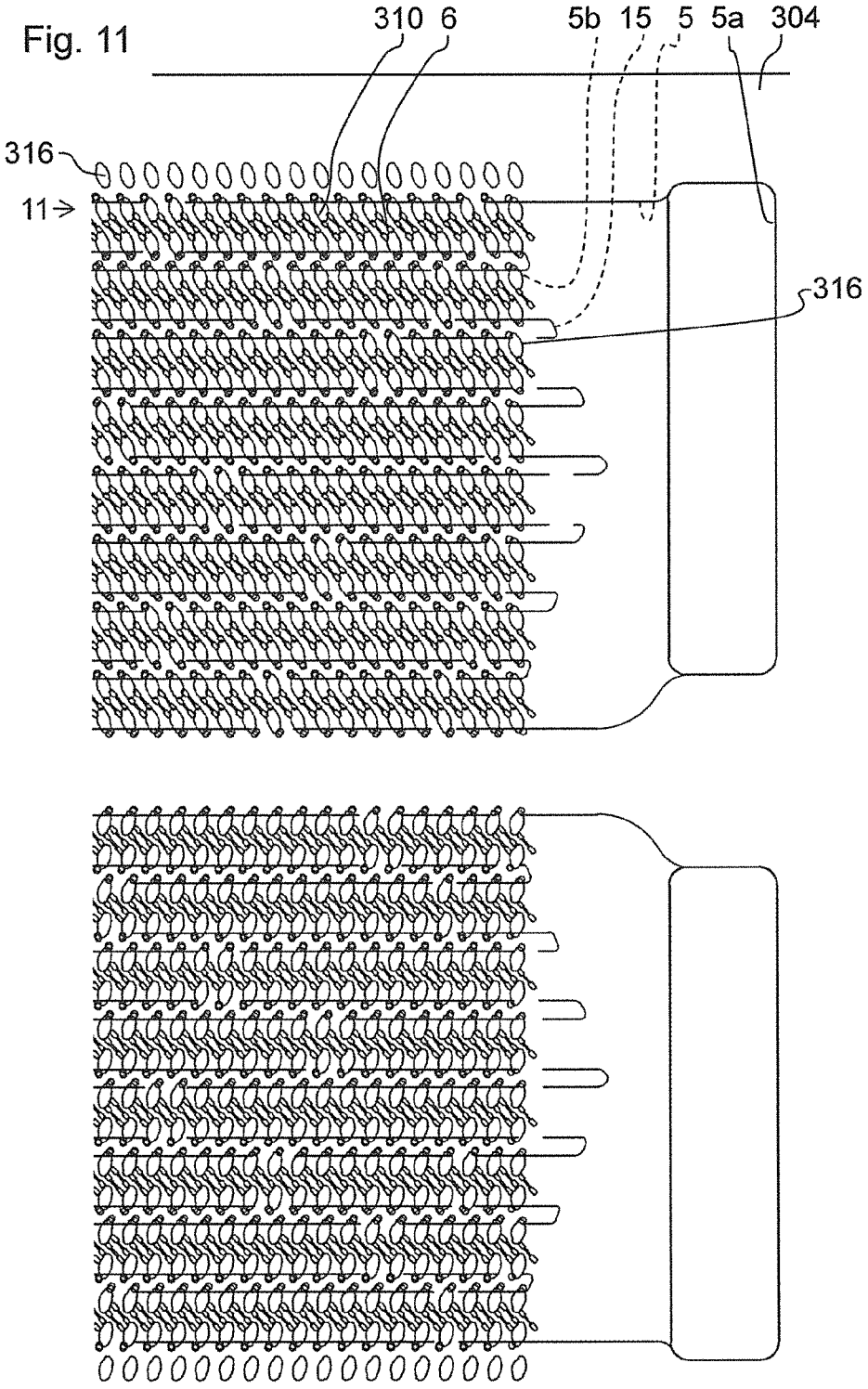
FIG. 11 is a partial plan view of a flow channel member for use in other liquid discharge head of the present invention.

A liquid discharge head of another embodiment of the present invention is described below. FIG. 11 is a partial plan view of a flow channel member 304 for use in the liquid discharge head of the another embodiment of the present invention. In FIG. 11, for the purpose of further clarification of the drawing, apertures 6 and the like, which are located inside the flow channel member 304 and therefore should be drawn by a dashed line, are drawn by a solid line. The discharge holes 8, the partial flow channels 13 respectively connecting the discharge holes 8 and the pressurizing chambers 310, and the like are omitted. The dimension in the vertical direction of the drawing is not shown in proportion to an actual dimension.

A basic structure of the entirety of the liquid discharge head is common to that shown in FIGS. 1 to 5. Components having less difference are identified by same reference characters, and their descriptions are omitted. A major difference is how planar shapes (planar tilts) of the pressurizing chamber 310 and a dummy pressurizing chamber 316, and the pressurizing chamber 310, and the discharge hole 8 are connected to one another. The shape of the partial flow channels 13 may be formed so that the movement in the planar direction is made on the side close to the pressurizing chamber 10 as shown in FIG. 6, or may be formed linearly.

Also in the flow channel member 304, similarly to the flow channel member 4 shown in FIG. 4, the pressurizing chambers 310 belonging to the pressurizing chamber columns disposed in the lateral direction of the single head body are respectively connected to the discharge holes 8 in the range R. When the length of the partial flow channel 13*b* connecting the pressuring chamber 310 and the discharge hole 8 varies significantly depending on the discharge hole 8, a large difference in discharge characteristics may occur. As described above, when the partial flow channel 13*b* has such a shape as to significantly move in the planar direction, the shape may affect the discharge direction. To improve this, the planar shape of the pressurizing chamber 310 is preferably made into a tilted shape so that the discharge hole 8 at the optimum position for connection is determined according to the shape. This ensures providing the liquid discharge head capable of minimizing the difference in the flow channel length of the flow channel directed from the pressurizing chamber to the discharge hole, as well as a recording device using the liquid discharge head.

Figure 12:
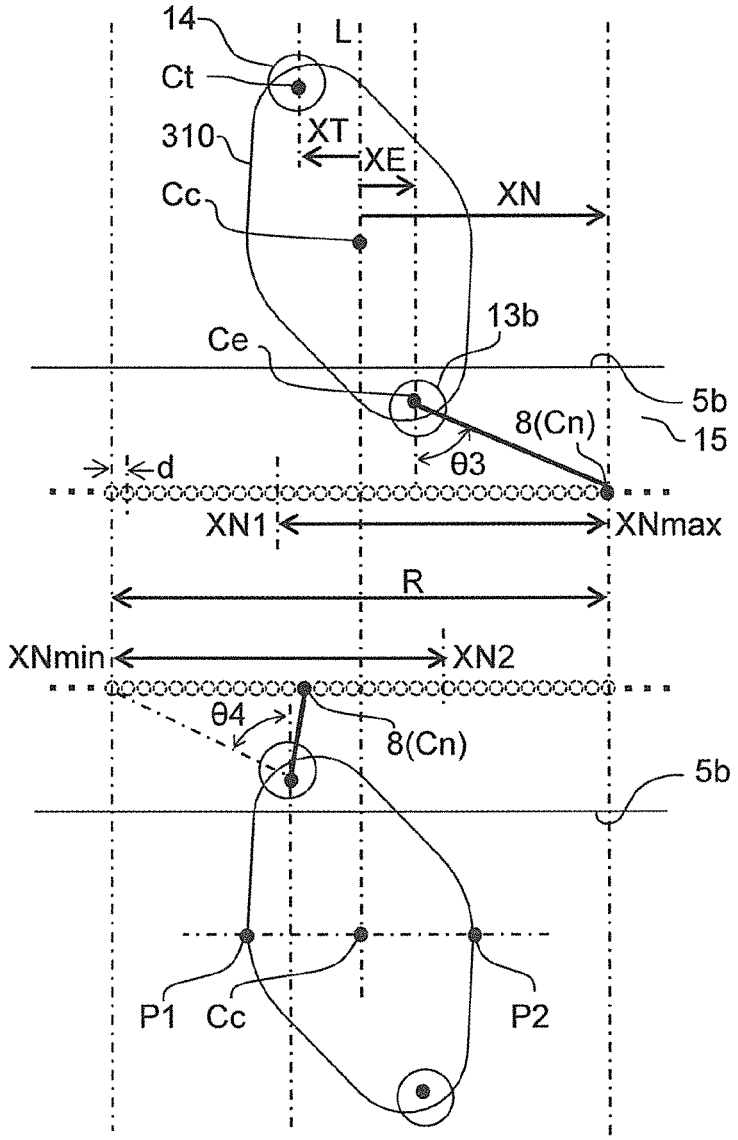
FIG. 12 is a partial schematic plan view of the flow channel member of FIG. 11.

The details thereof are described with reference to FIG. 12. FIG. 12 is a schematic plan view showing a layout relationship between the pressurizing chamber 310 and the discharge hole 8. The drawing shows the two pressurizing chambers 310 existing across a partition wall 15*a*, and the discharge holes 8 respectively connected to the pressurizing chambers 310. The two pressurizing chambers 310 belong to the same pressurizing chamber column and are disposed along a virtual straight line L extending in the lateral direction of the head body. Specifically, the area centroid Cc of each of the pressurizing chambers 310 is located on the virtual straight line L.

The discharge holes 8 connected from the pressurizing chambers 310 belonging to the single pressurizing chamber column are in the range R. The positions of the actually connected discharge holes 8 are drawn by a filled point, and the relative positions of the discharge holes 8 connected from other pressurizing chamber 310 are drawn by a chain line. The distance between the discharge holes 8 is kept constant (indicated by d [μm] in the drawing).

The planar shape of the pressurizing chamber 310 is long in one direction, and the width thereof is narrowed toward opposite ends in the one direction. The pressurizing chamber 310 is connected to the discharge hole 8 via the partial flow channel 13*b* in a first connection end that is one of the narrowed opposite ends, and is connected to the manifold 5 via the individual supply flow channel 14 in the other end. In the drawing, reference characters 13*b* and 14 indicate only the partial flow channels 13*b* and the individual supply flow channels 14 which are directly connected to the pressurizing chamber 310.

Relative positions of components are described below using a coordinate in which one in the longitudinal direction of the head body (the right in FIG. 12) is taken as positive. "Cc" is an area centroid of the pressurizing chamber 310. "Ce" is a position of a first connection end, specifically an area centroid of a planar shape of the portion at which the pressurizing chamber 310 and the partial flow channel 13*b* are connected to each other. In the present embodiment, the pressurizing chamber 310 and an end of the partial flow channel 13*b* are disposed shiftedly in the planar direction (not formed so that one includes therein the other), and hence C3 and Ce in FIG. 6 are different points. When the end of the partial flow channel 13*b* close to the pressuring chamber 310 is completely included in the pressurizing chamber 310, Ce agrees with Ce. The relative position of Ce with respect to Cc on the above-mentioned coordinate is indicated by XE [μm] (hereinafter, the relative position from Cc on the coordinate is generally referred to simply as a position or relative position with respect to Cc).

"Ct" is a position at which the pressurizing chamber 310 and the individual supply flow channel 14 connected to the manifold 5 are connected to each other, specifically, an area centroid of a planar shape of the portion at which the pressurizing chamber 310 and the individual supply flow channel 14 are connected to each other. Also, Ct is located at a second connection end of the opposite ends of the pressurizing chamber 310 which is not the first connection end connected to the partial flow channel 13*b*. The position of Ct with respect to Cc is indicated by XT [μm].

The position of the discharge hole 8 with respect to Cc is indicted by XN [μm]. A minimum value and a maximum value of XNs with respect to all the pressurizing chambers 310 are respectively indicated by XNmin [μm] and XNmax [μm]. In the present embodiment, the relative positions XNs of the discharge holes 8 connected from the pressurizing chambers 310 belonging to a pressurizing chamber column are 32 values disposed at intervals of "d" between XNmin and XNmax.

When the planar shape of the pressurizing chamber 310 is not tilted, namely, the value of XE is approximately zero, the length of the partial flow channel 13*b* is to be distributed over a wide range when the values of XN spread over a wide range. Accordingly, discharge characteristics may vary significantly. On the other hand, the difference in the length of the partial flow channels 13*b* can be minimized by making the planar shape of the pressurizing chamber 310 into such a shape that the values of XE have both positive and negative values, and by adjusting the value of XE of each pressurizing chamber 310 and the range of XN of the discharge hole 8 connected thereto as described later. Although the flow channel length is adjustable by making the partial flow channel 13*b* into such a shape obtained by bending it several times into a zigzag shape, this shape is unsuitable for the partial flow channel 13*b*. The partial flow channel 13*b* is preferably bent at least two times or less, more preferably one time or less. From the viewpoint of discharge characteristics, the partial flow channel 13*b* is preferably not bent halfway. When connected linearly, however, the discharge direction may vary. On that occasion, the partial flow channel 13*b* is preferably bent once halfway as shown in FIG. 6.

When considered an embodiment that a shape tilted in the longitudinal direction of the head body is employed as a planar shape of the pressurizing chamber 310 and both ends thereof are connected to the discharge hole 8, the value of XE has both a positive value and a negative value. In that case, the value of XE and the value of XN are approximately the same when the partial flow channel 13*b* proceeds immediately downwardly toward the discharge hole surface 4-1 so as to be connected to the discharge hole 8. In this embodiment, namely, in the head body in which XN has only two values, there is no need to make an adjustment by establishing a relationship between XE and XN in consideration of a difference in the length of the partial flow channels 13. Therefore, the present embodiment is intended for the head body having three or more different values as the value of XN.

The planar shape of the pressurizing chamber 310 is formed so that the width thereof is narrowed toward the first connection end on the side of the first connection end. Therefore, even when XE and XT are not zero, the distance between the first connection ends of the pressurizing chambers 310 adjacent to each other in the longitudinal direction of the head body is less apt to decrease. Particularly, the shape of an edge of the pressurizing chamber 310 extending from point P1 and point P2, at which a line extending from Cc in the longitudinal direction of the head body intersects with the end of the pressurizing chamber 310, to the first connection end is more preferably formed so as not to extend outwardly from P1 and P2 because the distance between the pressurizing chamber 310 and the pressurizing chamber 310 adjacent thereto is less apt to decrease. Also in the planar shape of the pressurizing chamber 310, on the side of a second connection end of the opposite ends of the pressurizing chamber 310 which is connected to the manifold 5, the width of the planar shape is narrowed toward the second connection end. Therefore, even when XE and XT are not zero, the distance between the second connection ends of the pressurizing chambers 310 adjacent to each other in the longitudinal direction of the head body is less apt to decrease. Particularly, the shape of an edge of the pressurizing chamber 310 extending from point P1 and point P2 to the second connection end is more preferably formed so as not to protrude in the longitudinal direction of the head body beyond P1 and P2 because the distance between the pressurizing chamber 310 and the pressurizing chamber 310 adjacent thereto is less apt to decrease.

The case where XNmax is positive and XNmin is negative indicates the presence of one in which a relative position of the discharge hole 8 from Cc is located on the right in FIG. 6, and one in which the relative position is located on the left. In such cases, when the pressurizing chamber 310 whose XN value is XNmin has a negative XE, the length of the partial flow channel 13*b* connected to the pressurizing chamber 310 can be decreased so as to minimise the difference in the length of the partial flow channels 13*b* in the entirety of the head body. Similarly, when the pressurizing chamber 310 whose XN value is XNmax has a positive XE, the length of the partial flow channel 13*b* connected to the pressurizing chamber 310 can be decreased so as to minimise the difference in the length of the partial flow channels 13*b* in the entirety of the head body.

In order to further minimize the difference in the length of the partial flow channels 13*b* in the entirety of the head body, the relative position XN of the discharge hole 8 connected to the pressuring chamber 310 having the positive XE preferably has a value relatively close to zero regardless of whether it is positive or negative. Similarly, the relative position XN of the discharge hole 8 connected to the pressuring chamber 310 having the negative XE preferably has a value relatively close to zero regardless of whether it is positive or negative.

Specifically, the relative position XN of the discharge hole 8 connected to the pressurizing chamber 310 having the positive XE (Ce is directed to the right) preferably falls within the two-thirds range having large values (the right side) in the range of XNmin to XNmax (including a value of XNmin and a value of XNmax, and the same hereinafter). The relative position XN of the discharge hole 8 connected to the pressurizing chamber 310 having the negative XE (Ce is directed to the left) preferably falls within the two-thirds range having small values (the left side) in the range of XNmin to XNmax. This ensures that the partial flow channel 13*b* connects Ce and the discharge hole 8 located relatively close to each other. Accordingly, it is possible to eliminate the long partial flow channel 13*b*, thereby minimizing the difference in the length of the partial flow channels 13*b* in the entirety of the head body.

The detailed description thereof is as follows. The range XNmin to XNmax that the value of XN can take is divided into three equal blocks: a block 1 that XN is in the range of XNmin to XNmin+(XNmax−XNmin)/3 (indicated by XN1 in FIG. 12), a block 2 that XN is in the range of XNmin+(XNmax−XNmin)/3 to XNmax−(XNmax−XNmin)/3 (indicated by XN2 in FIG. 12), and a block 3 that XN is in the range of XNmax−(XNmax−XNmin)/3 to XNmax. A connection is made from the pressurizing chamber 310 having a positive XE to the discharge hole 8 having a value in the ranges of the blocks 2 and 3 that are the two blocks having large numerical values of the relative position. That is, in the pressurizing chamber 310 having the positive XE, XN is in the range of XNmin+(XNmax−XNmin)/3 to XNmax. A connection is made from the pressurizing chamber 310 having a negative XE to the discharge hole 8 having a value in the ranges of the blocks 1 and 2 that are the two blocks having small numerical values of the relative position. That is, in the pressurizing chamber 310 having the negative XE, XN is in the range of XNmin to XNmax−(XNmax−XNmin)/3.

Moreover, when there is a pressurizing chamber 310 in which the value of XE is XNmax/2 or more, the XN of the pressurizing chamber 310 need to be in the range of 0 to XNmax. When there is a pressurizing chamber 310 in which the value of XE is XNmin/2 or less, the XN of the pressurizing chamber 310 need to be in the range of XNmin to 0. It is therefore possible to further minimize the difference in the length of the partial flow channels 13*b* in the entirety of the head body.

Also in the present embodiment, it is possible to consider an angle θ to be formed by the column direction and a line connecting C3 and the discharge hole 8 (more accurately, the area centroid Cn of the opening of the discharge hole 8 on the discharge hole surface 4-1) (in FIG. 12, a line connecting Ce and Cn is shown because C3 and Ce are extremely close to each other, thus making it difficult to observe). In the drawing, a maximum value of θ when Cn proceeds to the right side in the drawing is indicated by θ3, and a maximum value of θ when Cn proceeds to the left side in the drawing is indicated by θ4. In the normal liquid discharge head 2 (the liquid discharge head 2 in which the relationship between XE and XN is not adjusted as described above), the difference in the length of the partial flow channels 13*b* increases with increasing θ3 and θ4. Hence, when an attempt is made to keep the variations of discharge characteristics within a desired range, the value of θ has an upper limit. However, by adjusting the relationship between XE and XN as described above, the difference in the length of the partial flow channels 13*b* can be reduced even in the liquid discharge head 2 having θ3 and θ4 whose values are the same, thereby minimizing the variations of discharge characteristics. By adjusting θ3 and θ4 to 45 degrees or more as described above, the length in the lateral direction can be decreased, thus leading to production of the liquid discharge head 2 for high drive frequencies. Alternatively, θ3 and θ4 may be 60 degrees or more, or 75 degrees or more.

Figure 13:
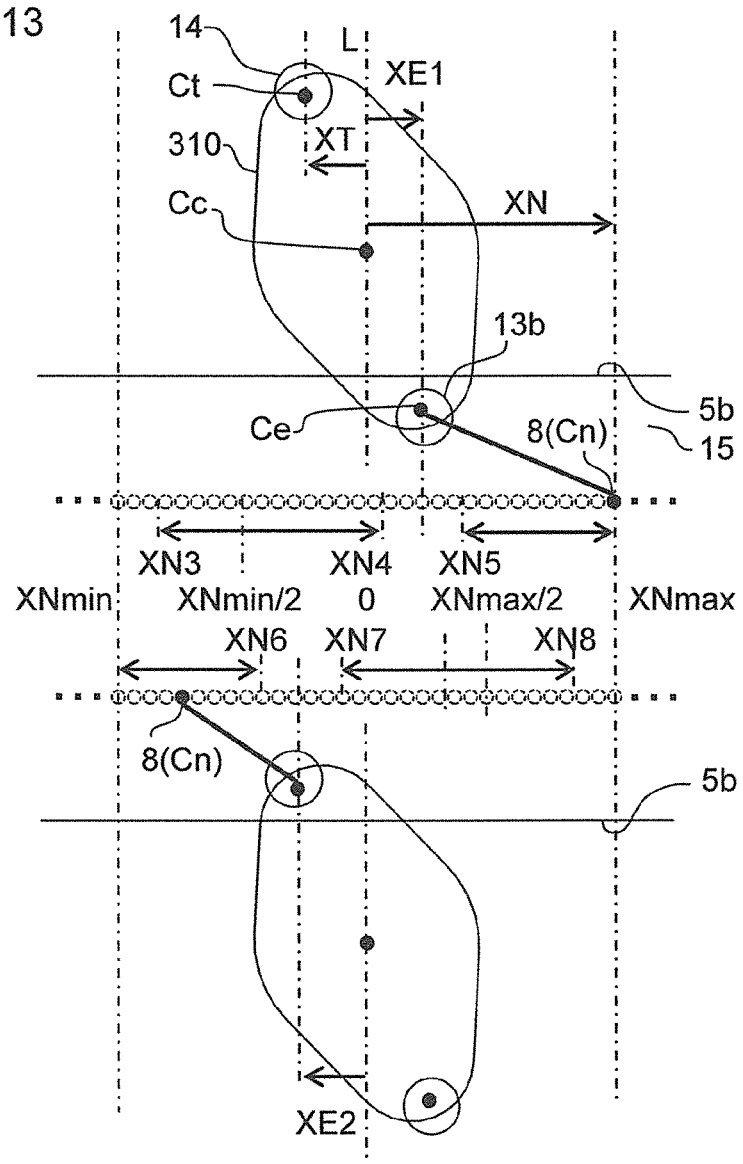
FIG. 13 is a partial schematic plan view of the flow channel member for use in other liquid discharge head of the present invention.

Other embodiment of the present invention is described with reference to FIG. 13 that is a partial schematic diagram of a flow channel member for use in the embodiment. Components shown in FIG. 13 are basically similar to those in FIG. 12, and therefore the descriptions thereof are omitted.

As the absolute value of XE is increased, the ends of the pressurizing chamber 310 become closer to the adjacent pressurizing chamber 310. This makes it difficult to design the region from P1 and P2 to the ends of the pressurizing chamber 310, to which the partial flow channel 13*b* is connected, so as not to be projected from P1 and P2. When the range of XE is in the range of XNmin/2 to XNmax/2, the angle of a direction being directed from Cc to Ce with respect to the virtual straight line L is small. Therefore, it is easy to design so as to prevent the occurrence of a projection, or it is easy to reduce the projection even if occurred.

In such cases, by preventing the value of XE and the value of XN in the pressurizing chamber 310 from having values extremely close to each other, the partial flow channel 13*b* having a small length can be eliminated, thereby further minimizing the difference in the length of the partial flow channels 13*b* in the entirety of the head body.

In order to prevent the connection to a region in which the length of the partial flow channel 13*b* is relatively long, and to a region in which the length is relatively short, a range that ensures a connection when the value of XE is positive in the range of XNmin to XNmax that the value of XN can take is limited to three-quarters of the range of XNmin to XNmax. Similarly, a range that ensures a connection when the value of XE is negative is limited to three-quarters of the range of XNmin to XNmax.

To be specific, firstly, XNB (=XNmax−XNmin)/12) that is the value of 1/12 in the range of XNmin to XNmax is considered. It is possible to prevent the partial flow channel 13*b* from being relatively long under the condition that the relative position XN of the discharge hole 8 connected to the pressurizing chamber 310 whose XE is positive (Ce is directed to the right) is not in the range of XNB of the smallest one (the leftmost side) in XNmin to XNmax. It is also possible to prevent the partial flow channel 13*b* from being relatively short under the condition that the relative position XN of the discharge hole 8 connected to the pressurizing chamber 310 is beyond the range of XE−XNB to XE+XBB. In conclusion, the XN of the pressurizing chamber 310 whose XE is positive is preferably in either one of the range of XNmin+(XNmax−XNmin)/12 (indicated by XN3 in FIG. 13) to XE−(XNmax−XNmin)/12 (indicated by XN4 in FIG. 13), and the range of XE+(XNmax−XNmin)/12 (indicated by XN5 in FIG. 13) to XNmax.

Similarly, it is possible to prevent the partial flow channel 13*b* from being relatively long under the condition that the relative position XN of the discharge hole 8 connected to the pressurizing chamber 310 whose XE is negative (Ce is directed to the left) is not in the range of XNB of the largest one (the rightmost side) in XNmin to XNmax. It is also possible to prevent the partial flow channel 13*b* from being relatively short under the condition that the relative position XN of the discharge hole 8 connected to the pressurizing chamber 310 is beyond the range of XE−XNB to XE+XBB. In conclusion, the XN of the pressurizing chamber 310 whose XE is negative is preferably in either one of the range of XNmin to XE−(XNmax−XNmin)/12 (indicated by XN6 in FIG. 13), and the range of XE+(XNmax−XNmin)/12 (indicated by XN7 in FIG. 13) to XNmax−(XNmax−XNmin)/12 (indicated by XN8 in FIG. 13).

The difference in the length of the partial flow channels 13*b* in the entirety of the head body may be further reduced in the following manner. That is, the range of XNmin to XNmax is divided into four equal sections, and these sections are respectively named as blocks 11 to 14 in ascending order. Any connection is made from the pressurizing chamber 310 whose XE is positive to neither the remotest block 11 nor the nearest block 13. Consequently, the length of the partial flow channels 13*b* corresponds to the block 12 and the block 14 that ensures a medium length, thereby further minimizing the difference in the length of the partial flow channels 13*b* in the entirety of the head body. Similarly, any connection is made from the pressurizing chamber 310 whose XE is negative to neither the remotest block 14 nor the nearest block 12. Consequently, the length of the partial flow channels 13*b* corresponds to the block 11 and the block 13 that ensure a medium length, thereby further minimizing the difference in the length of the partial flow channels 13*b* in the entirety of the head body. In FIG. 13, two pressurizing chambers 310 are shown, and hence the XE of the pressurizing chamber 310 located on the upper side of the drawing is indicated by XE1, and the XE of the pressurizing chamber 310 located on the lower side of the drawing is indicated by XE2.

When this is expressed similarly to other one, the XN of the pressurizing chamber 310 whose XE is positive is preferably in either one of the range of −(XNmax−XNmin)/4 to 0, and the range of (XNmax−XNmin)/4 to XNmax. The XN of the pressurizing chamber 310 whose XE is negative is preferably in either one of the range of XNmin to −(XNmax−XNmin)/4, and the range of 0 to (XNmax−XNmin)/4.

Figure 14A:
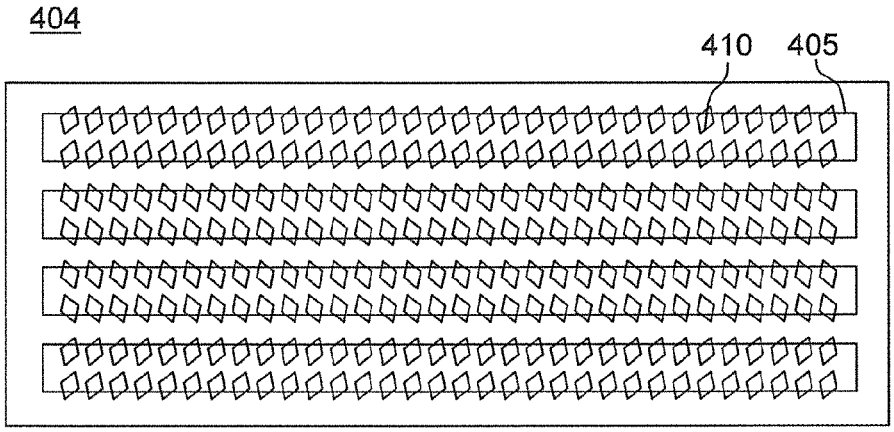
FIGS. 14(*a*) to 14(*c*) are plan views of the flow channel member for use in other liquid discharge of the present invention.
Figure 14B:
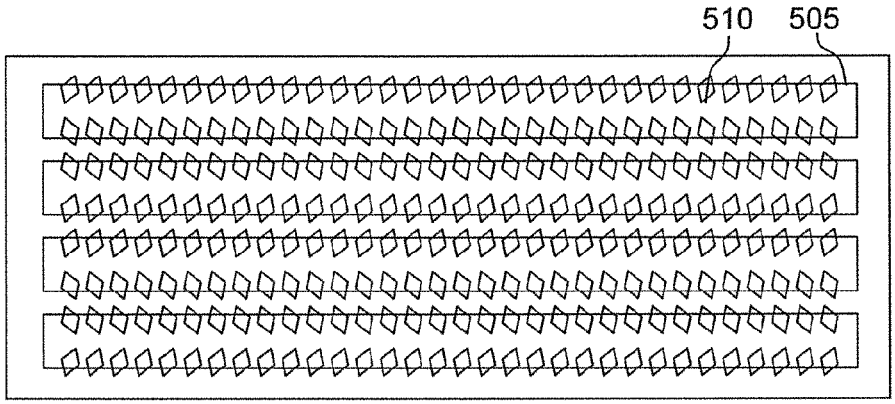
Figure 14C:
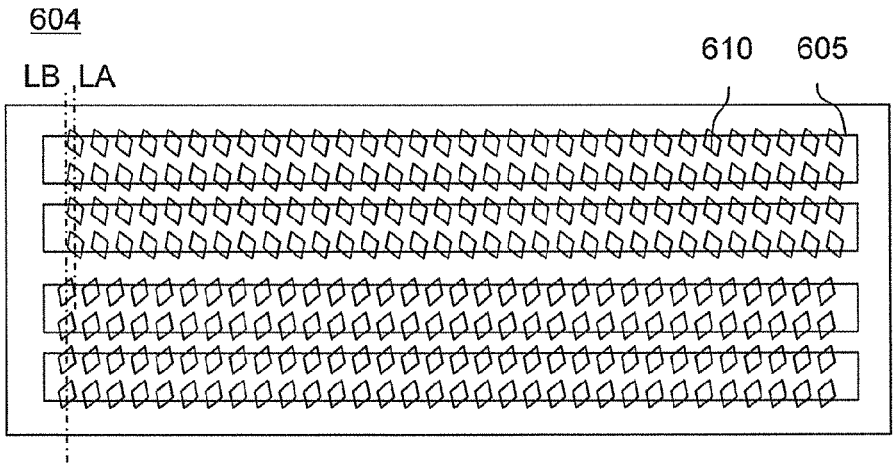

FIG. 14(*a*) is a plan view of a flow channel member 404 for use in a liquid discharge head of other embodiment of the present invention. Similarly to the flow channel member 4, the flow channel member 404 is usable for the head body. The flow channel member 404 includes eight pressurizing chamber rows each having pressurizing chambers 410 disposed along the longitudinal direction of the flow channel member 404 (namely, along the longitudinal direction of the head body). The pressurizing chambers 410 are also disposed in a column direction that is the direction intersecting a row direction. In the drawing, the row direction and the column direction are orthogonal to each other, thereby ensuring that a small head body can be designed without increasing crosstalk. These two directions are not necessarily be orthogonal to each other. The flow channel member 404 includes four manifolds 405 disposed along the longitudinal direction of the flow channel member 404. For the purpose of further clarification of the drawing, the manifolds 405 and the pressurizing chambers 410 in a transmissive view are drawn by a solid line.

The flow channel member 404 has a cross-sectional structure similarly to the flow channel member 4 shown in FIG. 5. The pressurizing chamber 410 is long in one direction and the width thereof is narrowed toward opposite ends thereof. One end of the pressurizing chamber 410 which is not overlapped with the manifold 4 05 is connected to the discharge hole 8 via the partial flow channel 13*b*. The other end of the pressurizing chamber 410 which is overlapped with the manifold 5 is connected to the manifold 405 via the aperture 6. In FIG. 14(*a*), the flow channels other than the manifolds 4 05 and the pressurizing chambers 410 are omitted.

In each of the pressurizing chambers 410, XT is negative when XE is positive, and XT is positive when XE is negative. That is, the longitudinal direction of the pressurizing chamber 410 is tilted with respect to the direction orthogonal to the longitudinal direction of the head body. Moreover, the pressurizing chamber rows are in agreement on the tilt direction. Owing to the agreement on the tilt direction, the distance between the pressurizing chambers 410 in the pressurizing chamber row is less apt to decrease (more specifically, the distance between the portions of the pressurizing chambers 410 which are close to the partial flow channel 13*b* is less apt to decrease, and the distance between those close to the individual supply flow channel 14 is less apt to decrease), thus minimizing the crosstalk. The pressurizing chambers 410 in the pressurizing chamber row preferably have the same angle of tilt in order to reduce the crosstalk. A state in which the pressurizing chamber 410 is rotated to the left, such as the pressurizing chamber 410 on the upper side in FIG. 14(*a*), denotes being tilted to the left.

When the pressurizing chamber rows having different tilt directions are included in the flow channel member 404, it is easy to design when the relationship between the value of XE and the value of XN is established under the foregoing conditions. When the longitudinal directions of the pressurizing chambers 410 are aligned in the flow channel member 404, strength may be lowered in the direction orthogonal to the alignment direction. However, the presence of the pressurizing chamber rows having different tilt directions is preferable because the direction along which rigidity is low is less apt to occur. It is also possible to suppress the occurrence of resonance in a specific direction.

However, when there are the pressurizing chamber rows having different tilt directions, the distance between the ends of the pressurizing chambers 410 is decreased between the adjacent rows, and the crosstalk may increase therebetween. In that case, the distance between the pressurizing chamber rows having different tilt directions needs to be larger than the distance between the pressurizing chamber rows having the same tilt direction. In the flow channel member 404, the first, second, fifth, and sixth pressurizing chamber rows from the upper side in the drawing are tilted to the right, and their tilt directions are the same. The third, fourth, seventh, and eighth pressurizing chamber rows from the upper side in the drawing are tilted to the right, and their tilt directions are aligned. The second and third pressurizing chamber rows from the upper side have different tilt directions. By increasing the distance between these two rows than the distance between the pressurizing chamber rows having the same tilt direction, the distance between the end of the pressurizing chamber 410 belonging to the fourth pressurizing chamber row, which is close to the partial flow channel 13*b*, and the end of the pressurizing chamber 410 belonging to the fifth pressurizing chamber row, which is close to the partial flow channel 13*b*, can be increased to suppress the crosstalk. The distance between the fourth and fifth rows from the upper side, and the distance between the sixth and seventh rows from the upper side are also increased similarly.

FIG. 14(*b*) is a plan view of a flow channel member 504 for use in a liquid discharge head of other embodiment of the present invention. A basic configuration of the flow channel member 504 is identical to that of the flow channel member 404, and therefore the description thereof is omitted.

There are a plurality of the manifolds 405, and there are two pressurizing chamber rows, one on each side of the single manifold 405. When the manifold 405 is connected thereto, pressurizing chambers 510 preferably have different tilts on the adjacent pressurizing chamber rows connected to the single manifold 505, and the pressurizing chambers 510 preferably have the same tilt on the adjacent pressurizing chamber rows connected to different manifolds 505. With this arrangement, by increasing a separation distance between the pressurizing chamber rows having different tilts, the cross sectional area of the manifold 505 can be increased to increase a flow rate of liquid. Moreover, the portions of the pressurizing chambers 510 which are connected to the partial flow channel are alternately disposed on a partition wall between the manifolds 505, thereby facilitating arrangement of the partial flow channels.

FIG. 14(*c*) is a plan view of a flow channel member 604 for use in a liquid discharge head of other embodiment of the present invention. A basic configuration of the flow channel member 604 is identical to that of the flow channel member 404, and therefore the description thereof is omitted.

In the flow channel member 604, pressurizing chambers 610 are divided and disposed in two groups, and the pressurizing chambers 610 belonging to each of these two groups are in agreement on the tilt direction. The first to fourth pressurizing chamber rows from the upper side in the drawing constitute a pressurizing chamber group, and the pressurizing chambers 610 belonging thereto are tilted to the left. The first to fourth pressurizing chamber rows from the lower side in the drawing constitute a pressurizing chamber group, and the pressurizing chambers 610 belonging thereto are tilted to the right. These two pressurizing chamber groups are different in tilt direction, thereby enhancing the rigidity of the flow channel member 604. The two pressurizing chamber groups are spaced apart from each other so as to suppress the crosstalk. As the number of pressurizing chamber groups is increased, a sum of separation distances is increased to elongate the length of the flow channel member 604 in the lateral direction thereof. However, the length can be decreased because there are only the two pressurizing chamber groups.

When the pressurizing chambers 610 are respectively disposed in the pressurizing chamber groups along a column direction that is a second direction approximately orthogonal (within 90±10 degrees) to a row direction that is a first direction, the pressurizing chamber columns are shiftedly disposed in the first direction in the two pressurizing chamber groups. This allows the positions of Ce be different from one another depending on the pressurizing chamber group, thereby minimizing the difference in the length of the partial flow channels.

"LA" is a virtual straight line connecting area centroids Cc of the pressurizing chamber columns at the left ends of the pressurizing chamber groups on the upper side in the drawing, and "LB" is a virtual straight line connecting area centroids Cc of the pressurizing chamber columns at the left ends of the pressurizing chamber groups on the lower side in the drawing. The virtual straight lines LA and LB are deviated from each other in the row direction as described above. The amount of deviation between LA and LB in the row direction is preferably approximately a half of the distance between the area centroids Cc of the pressurizing chambers 610 in the pressurizing chamber row. This facilitates such an arrangement that reduces the difference in the distance of the partial flow channels. For example, when the range R is printed by the single pressurizing chamber column of the upper pressurizing chamber group and the single pressurizing chamber column of the lower pressurizing chamber group (the discharge holes are disposed accordingly), the printing of a range of R/2 is performed by the single pressurizing chamber column of the upper pressurizing chamber group, and the printing of a range of R/2 excluding the foregoing range of R/2 is performed by the single pressurizing chamber column of the lower pressurizing chamber group. This contributes to narrowing the range to be covered by the single pressurizing chamber column of the single pressurizing chamber group, thus minimizing the difference in the length of the partial flow channels.

Figure 15:
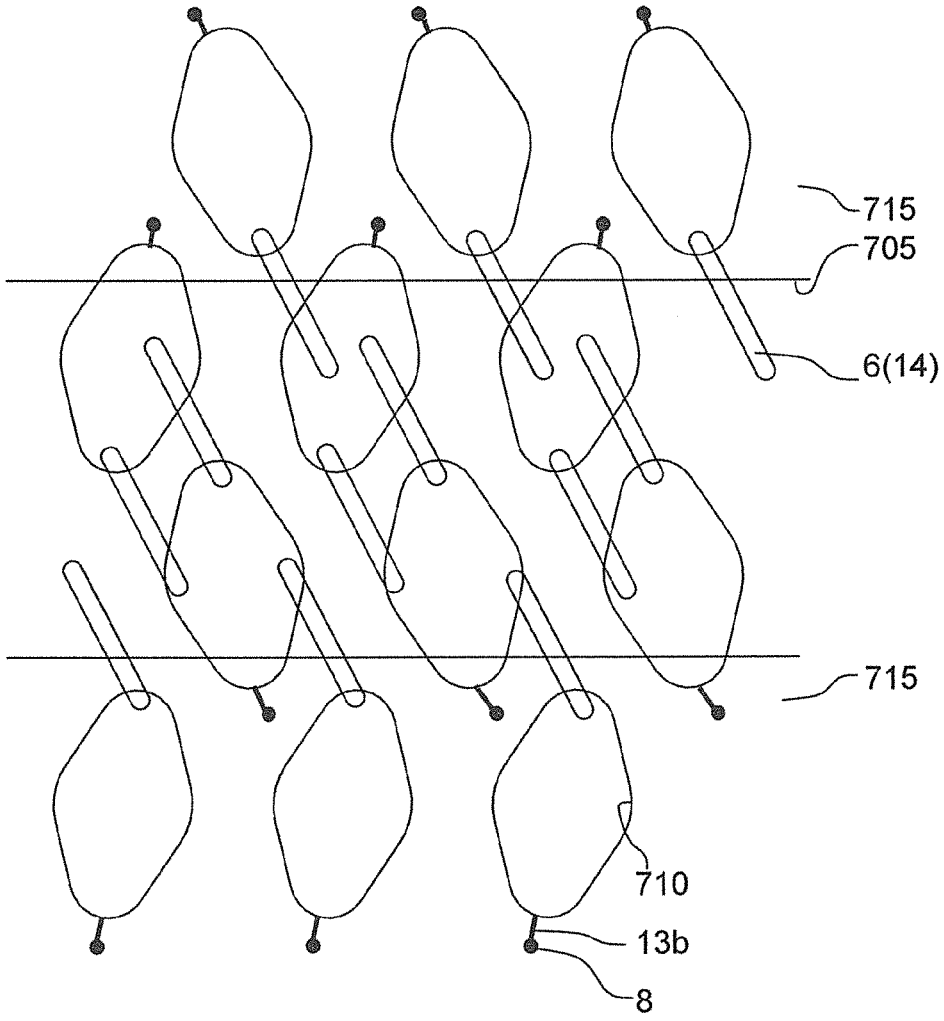
FIG. 15 is a schematic partial plan view of the flow channel member for use in other liquid discharge head of the present invention.

FIG. 15 is a schematic plan view showing in enlarged dimension a part of a flow channel member for use in a liquid discharge head of other embodiment of the present invention. The drawing shows four pressurizing chamber rows connected to a manifold 705. A flow channel is connected sequentially from the manifold 705 to the aperture 6 (individual supply flow channel 14), a pressurizing chamber 710, the partial flow channel 13*b*, and the discharge hole 8. The discharge hole 8 is disposed immediately below a partition wall 715. One or a plurality of the manifolds 705 may be disposed in the liquid discharge head.

The pressurizing chambers 710 are disposed on a plurality of rows along a first direction that is the longitudinal direction of the head body. The pressurizing chambers 710 belonging to pressurizing chamber rows adjacent to each other are disposed in a staggered shape between the pressurizing chambers 710 belonging to the adjacent pressurizing chamber rows in the column direction.

The manifolds 705 are disposed along the column direction and are connected to pressurizing chambers 810 of the four pressurizing chamber rows, two on each side of the manifolds 705. The pressurizing chambers 710 are connected to the manifolds 705 at one of opposite ends of the pressurizing chambers 710 which is close to the manifolds 705.

In this liquid discharge head, the pressurizing chambers 810 belonging to the single pressurizing chamber row are in agreement on whether XE is positive or negative. The inner two and outer two of the four pressurizing chamber rows connected to the manifolds 705 are respectively in agreement on whether XE is positive or negative, and the inner two rows and the outer two rows differ in whether XE is positive or negative. This ensures such an arrangement that avoids a decrease in the distance between opposite ends of each of the pressurizing chambers 810 (the end connected to the partial flow channel 13*b* and the end connected to the individual supply flow channel 14). Consequently, the pressurizing chambers 810 can be disposed tiltedly while suppressing the crosstalk, thereby facilitating such an arrangement that minimizes the difference in the length of the partial flow channels 13*b*.

Figure 16:
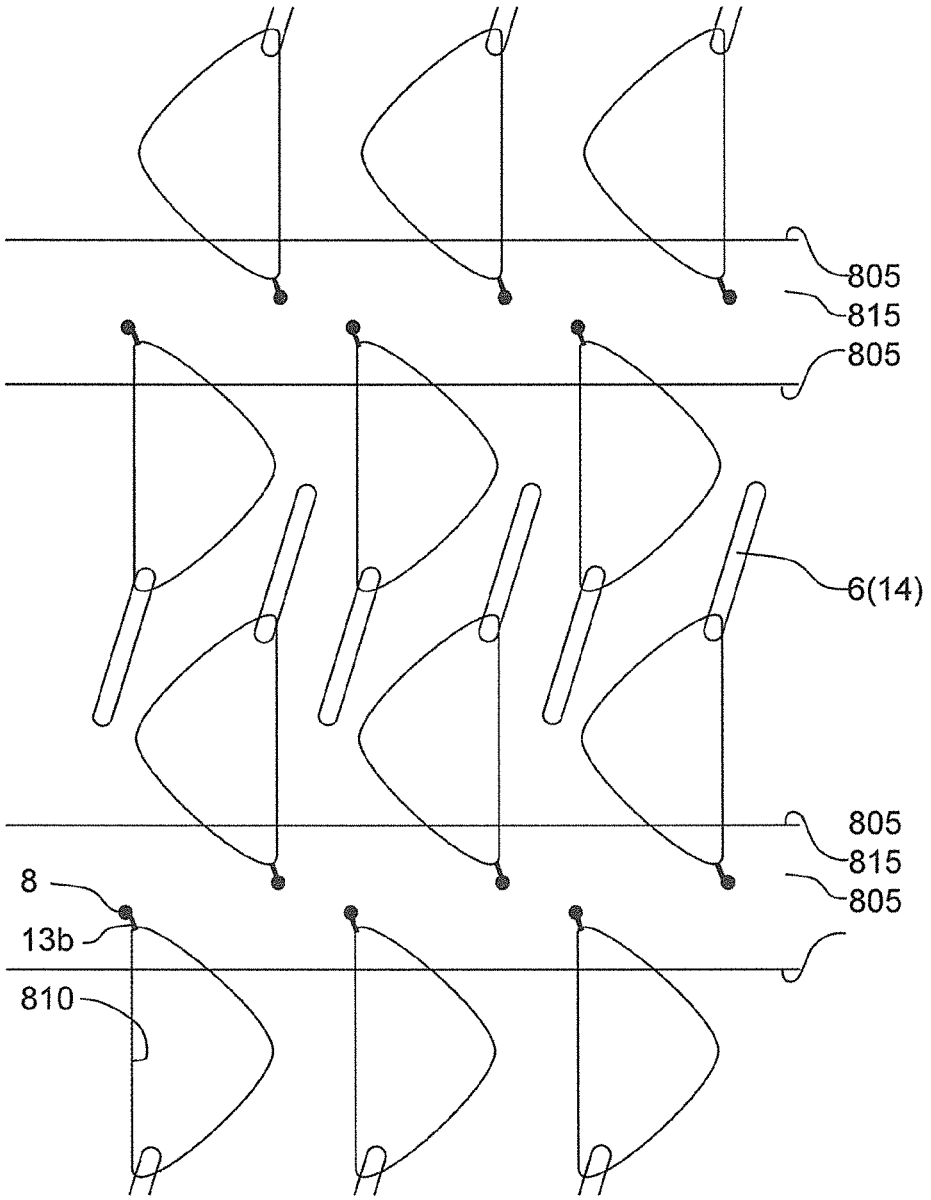
FIG. 16 is a schematic partial plan view of the flow channel member for use in other liquid discharge head of the present invention.

FIG. 16 is a schematic plan view showing in enlarged dimension a part of a flow channel member for use in a liquid discharge head of other embodiment of the present invention. The drawing shows two pressurizing chamber rows respectively connected to two manifolds 805. A flow channel is connected sequentially from the manifold 805 to the aperture 6 (individual supply flow channel 14), the pressurizing chamber 810, the partial flow channel 13*b*, and the discharge hole 8. The discharge hole 8 is disposed immediately below a partition wall 815. One or a plurality of the manifolds 805 may be disposed in the liquid discharge head.

The manifold 805 is connected via one of opposite ends of the pressurizing chamber 810 which is not connected to the discharge hole 8. The pressurizing chambers 810 belonging to the single pressurizing chamber row are in agreement on whether XE is positive or negative. The rows adjacent to each other differ in whether XE is positive or negative. In the pressurizing chamber 810 whose XE is positive among the pressurizing chambers 810, XT is positive and XE is negative. This decreases the distance between the pressurizing chambers 810. Consequently, the position of Ce with respect to the area centroid Cc can be deviated in the column direction while suppressing the occurrence of crosstalk, thereby facilitating an arrangement that minimizes the difference in the length of the partial flow channels 13*b*. The liquid discharge head 2 is produced, for example, in the following manner. A tape made of piezoelectric ceramic powder and an organic composition is formed by a general tape forming method, such as roll coater method or slit coater method. After firing the tape, a plurality of green sheets serving as piezoelectric ceramic layers 21*a* and 21*b* are produced. An electrode paste serving as the common electrode 24 is formed on the surface of a part of the green sheets by printing method or the like. A via hole is formed on a part of the green sheets as necessary, and a via conductor is charged into the via hole.

Subsequently, the green sheets are laminated one upon another to produce a laminate body, followed by pressurized adhesion. The laminate body after being subjected to the pressurized adhesion is fired in a high-concentration oxygen atmosphere. Thereafter, the individual electrode 25 is printed on the surface of a fired body by using an organic gold paste, followed by firing. Then, the connection electrode 26 is printed using an Ag paste, followed by firing, thus producing the piezoelectric actuator substrate 21.

Subsequently, plates 4*a* to 41 obtained by a rolling method or the like are laminated one upon another while interposing therebetween an adhesive layer, thereby producing the flow channel member 4. Holes, which become the manifold 5, the individual supply flow channel 14, the pressurizing chamber 10, the partial flow channel 13*b*, and the discharge hole 8, are respectively produced into a predetermined shape in the plates 4*a* to 41 by etching.

These plates 4*a* to 41 are preferably formed of at least one kind of metal selected from the group consisting of Fe—Cr based ones, Fe—Ni based ones, and WC—TiC based ones. Particularly, when ink is used as the liquid, these plates are preferably made of a material with excellent corrosion resistance to the ink. Therefore, the Fe—Cr based ones are more preferable.

The piezoelectric actuator substrate 21 and the flow channel member 4 can be stacked and adhered to each other with, for example, an adhesive layer interposed therebetween. As the adhesive layer, any well-known one is usable. However, in order to avoid the influence on the piezoelectric actuator substrate 21 and the flow channel member 4, it is preferable to use at least one kind of thermosetting resin-based adhesive selected from the group consisting of epoxy resins, phenol resins, and polyphenylene ether resins, each having a thermosetting temperature of 100 to 150°C. The piezoelectric actuator substrate 21 and the flow channel member 4 can be heat-bonded to each other by being heated up to the thermosetting temperature by using the adhesive layer. After the bonding, a voltage is applied between the common electrode 24 and the individual electrode 25 so as to polarize the piezoelectric ceramic layer 21*b* in the thickness direction thereof.

Subsequently, to electrically connect the piezoelectric actuator substrate 21 and the control circuit 100, a silver paste is supplied to the connection electrode 26, and an FPC, which is the signal transmission section 92 having a driver IC previously mounted thereon, is placed thereon, and heat is applied thereto so as to cure the silver paste, thus achieving the electrical connection. When mounting the driver IC, an electrical flip-chip connection to the FPC is made with solder, and thereafter a protective resin is supplied and cured on the circumference of the solder.

EXAMPLES

The liquid discharge head 2 including the partial flow channels 13*b* was produced in which the partial flow channels 13*b* had the same basic structure as that shown in FIG. 6, and were subjected to different movements from C3 to C1 in the planar direction. The relationship between the shape of the partial flow channels 13*b* and the discharge direction was confirmed. The structure of the partial flow chancels 13*b*, which was common to evaluations, was L=900 μm and W=135 μm. The single liquid discharge head 2 included therein the partial flow channels 13*b* in which the distance of D3 (distance between C1 and C3 in the direction parallel to the discharge hole surface) was from approximately 0 μm (one which caused approximately no movement in the longitudinal direction of the liquid discharge head 2 and slight movement in the lateral direction thereof) to 340 μm. The angles θ1 and θ2 to be formed by the straight line connecting C3 and Cn and the column direction were 75 degrees.

Firstly, there were produced ones in which the portion of the partial flow channel 13*b* (an orthogonal portion) which was located close to the nozzle part and was formed into a shape orthogonal to the discharge hole surface 4-1 by changing the length thereof to 110 μm, 270 μm, or 410 μm. Conversely, the movement of the distance of D3 in the planar direction was made on the upper side than the orthogonal portion.

Figure 9A:
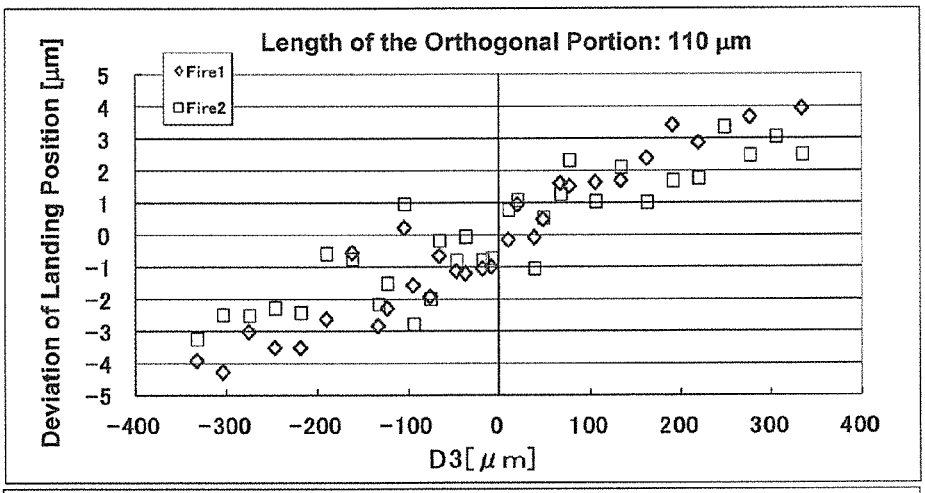
FIGS. 9(*a*) to 9(*c*) are graphs showing a relationship between the shape of a partial flow channel and a landing position.
Figure 9B:
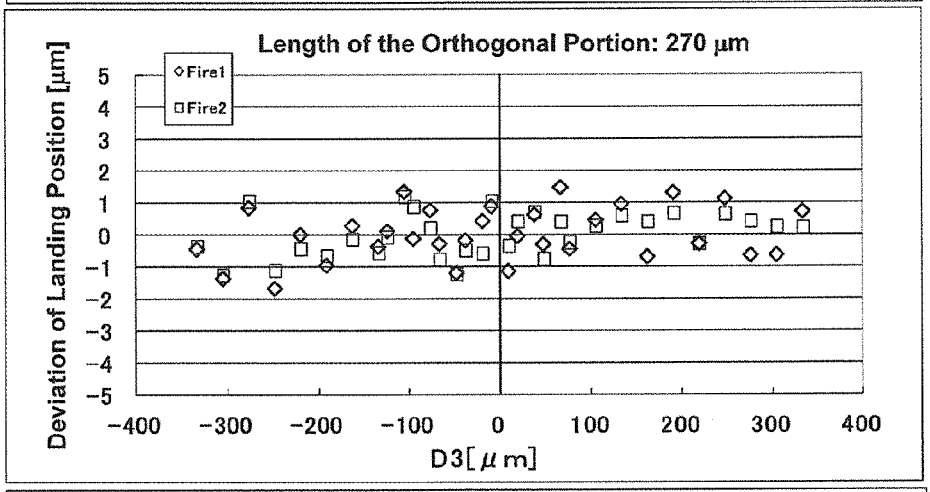
Figure 9C:
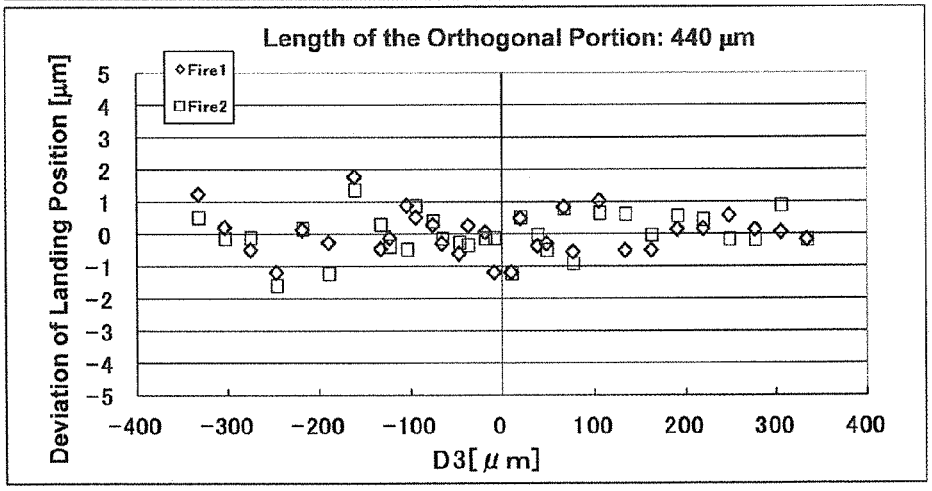

The relationship of misalignment between the distance of D3 and the measured landing position was shown in graphs in FIGS. 9(*a*) to 9(*c*). In terms of D3, a mark was put depending on whether the direction being directed from C3 to C1 (C2) was directed to one direction or another direction in the longitudinal direction of the liquid discharge head 2. The landing positions were evaluated on the basis of misalignment when landed on a surface located 1 mm away from the discharge hole surface 4-1. In terms of the misalignment, only deviation in the longitudinal direction was measured, and a mark was put similarly to the direction being from C3 to C1. "Fire1" and "Fire2" had different pulse widths of a drive waveform, and "Fire2" had a longer pulse width than "Fire1" so as to discharge a large liquid drop. The liquid discharge head having the orthogonal portion of 110 μm was beyond the scope of the present invention.

The graph of FIG. 9(*a*) shows that in the liquid discharge head 2 having the orthogonal portion of 110 μm, the direction in which the landing position is deviated agrees with the direction being directed from C3 to C2, and the amount of deviation of the landing position is proportional to the distance of D3. On the other hand, in the liquid discharge head 2 having the orthogonal portion of 270 μm in FIG. 9(*b*), and the liquid discharge head 2 having the orthogonal portion of 410 μm in FIG. 9(*c*), approximately no correlation between the landing position and the value of D3 is observed. This shows that the variations in the discharge direction is suppressible by disposing the orthogonal portion having the length that is twice a mean diameter W (=135 μm) of the partial flow channels 13*b*, on the portion of the partial flow channel 13*b* which is close to the nozzle part.

Subsequently, a liquid discharge head 2 was produced in which the region from C3 to C1 was connected approximately linearly as the partial flow channel 13*b*. This liquid discharge head 2 was not within the scope of the present invention. However, the evaluation of the value of D2 (the distance between C2 and C1, which are the positions located 2 W away from the nozzle part 13*a* of the partial flow channel 13*b*, in the planar direction) and the evaluation of the deviation of the landing position indicate to what extent orthogonality of the direction of the region of 2 W of the partial flow channel 13*b* which is close to the nozzle part and the discharge hole surface is required.

Figure 10:
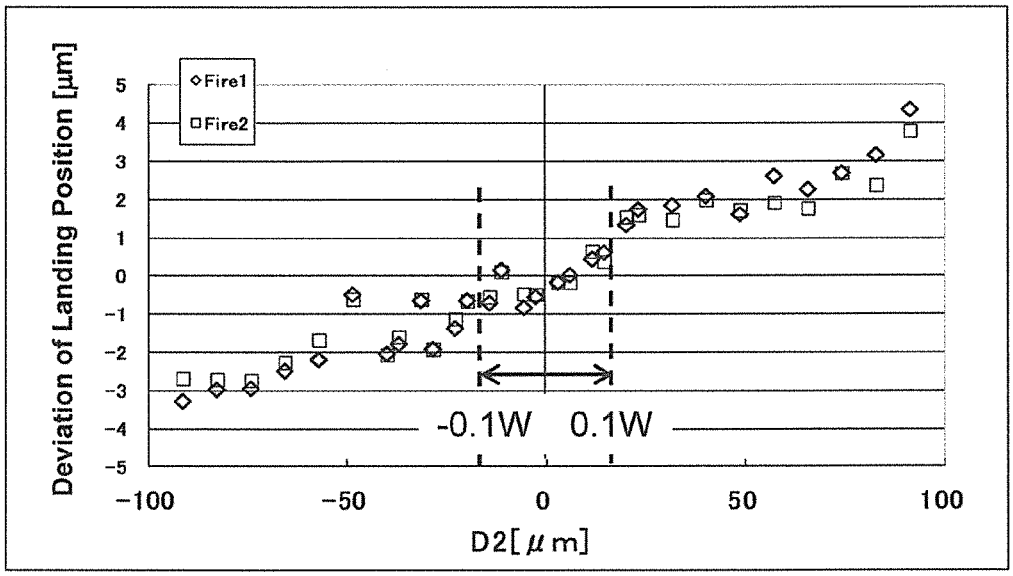
FIG. 10 is a graph showing a relationship between the shape of the partial flow channel and a landing position.

The evaluation results are shown in FIG. 10. By decreasing the distance of D2 to 0.1 W (=13.5 μm) or less, the deviation of the landing position is 1 μm or less, thus showing that the deviation can be reduced to approximately the same extent as the variations in FIGS. 9(*b*) and 9(*c*). It seems similarly that in the liquid discharge head 2 of the present invention, the orthogonality of the orthogonal portion with respect to the discharge hole surface 4-1 needs to be set to approximately the same extent. That is, under the condition that the movement distance D2 in the planar direction in the region located 2 W away from the nozzle part of the partial flow channel 13*b* is 0.1 W or less, the deviation of the landing position can be sufficiently minimized. This deviation of the landing position ensures precise printing of 1200 dpi.

DESCRIPTION OF REFERENCE CHARACTERS 1 printer
2 liquid discharge head
2*a* head body
4, 304, 404, 505, 604 flow channel member
4*a* to 41 plate
4-1 discharge hole surface
4-2 pressurizing chamber surface
5, 405, 505, 605, 705, 805 manifold
5*a* opening (of manifold)
5*b* sub manifold

6 aperture
8 discharge hole
9 discharge hole row
10, 210, 310, 410, 510, 610, 710, 810 pressurizing chamber
11 pressurizing chamber row
12 individual flow channel
13 flow channel (connecting pressurizing chamber and discharge hole)
13*a* nozzle part
13*b* partial flow channel (descender)
13*ba* narrowed portion
14 individual supply flow channel
15, 715, 815 partition wall
16, 316 dummy pressurizing chamber
21 piezoelectric actuator substrate
21*a* piezoelectric ceramic layer (vibrating plate)
21*b* piezoelectric ceramic layer
24 common electrode
25 individual electrode
25*a* individual electrode body
25*b* extraction electrode
26 connection electrode
28 surface electrode for common electrode
30 displacement element (pressurizing part)
C1 area centroid of end of partial flow channel which is close to nozzle part
C2 area centroid of position located 2 W away from portion of partial flow channel which is close to nozzle part
C3 area centroid of end of partial flow channel close to pressurizing chamber
Cc area centroid of pressurizing chamber
Ce position of first connection end
Cn area centroid of discharge hole
Ct position of second connection end
XE relative position of first connection end with respect to pressurizing chamber
XN relative position of discharge hole with respect to pressurizing chamber
XT relative position of second connection end with respect to pressurizing chamber

The invention claimed is:

1. A liquid discharge head, comprising:

a flow channel member comprising one or a plurality of discharge holes, a discharge hole surface having an opening of the discharge hole, one or a plurality of pressurizing chambers, and one or a plurality of flow channels connecting the discharge hole and the pressurizing chamber, and a pressurizing part configured to pressurize a liquid in the pressurizing chamber, wherein the flow channel comprises a nozzle part with a cross section narrowed near the discharge hole, and a partial flow channel excluding the nozzle part, and wherein the partial flow channel is formed so that a distance between Cm and C1 in a direction parallel to the discharge hole surface is larger than 0.1 W [μm] and a distance between C2 and C1 in a direction parallel to the discharge hole surface is 0.1 W [μm] or less, wherein W [μm] is a mean diameter of the partial flow channel, C1 is an area centroid of a cross section, of the partial flow channel, parallel to the discharge hole surface on a side of the partial flow channel which is close to the nozzle part, C2 is an area centroid of a cross section, of the partial flow channel, parallel to the discharge hole surface at a position located 2 W [μm] away from a side of the partial flow channel which is close to the nozzle part in a direction orthogonal to the discharge hole surface, C3 is an area centroid of a cross section, of the partial flow channel, parallel to the discharge hole surface on a side of the partial flow channel which is close to the pressurizing chamber, and Cm is an intersection of a straight line connecting C1 and C3, and a plane parallel to the discharge hole surface at a position located 2 W [μm] away from the side close to the nozzle part in a direction orthogonal to the discharge hole surface.

2. The liquid discharge head according to claim 1, wherein the flow channel member comprises a plurality of the discharge holes, a plurality of the pressurizing chambers, and a plurality of the flow channels, and has a flat plate shape, wherein a plurality of the discharge holes are disposed in one direction so as to form a plurality of discharge hole rows, wherein a plurality of the pressurizing chambers are arranged in a column direction that is a direction intersecting the one direction so as to form a plurality of pressurizing chamber columns, and wherein there exists the partial flow channel having an angle θ of 45 degrees or more, the angle θ being formed by a straight line connecting Cn and C3 that are area centroids of openings of the discharge holes and the column direction in a plan view of the flow channel member.

3. The liquid discharge head according to claim 2, wherein area centroids of planar shapes of a plurality of the pressurizing chambers are disposed in a lattice shape in the plan of the flow channel member.

4. The liquid, discharge head according to claim 2, wherein there exists the partial flow channel in which a distance between C3 and C1 in a direction parallel to the discharge hole surface is 2 W [μm] or more.

5. The liquid discharge head according to claim 1, further comprising a narrowed portion formed between the side of the partial flow channel which is close to the nozzle part and a position located 2 W [μm] away in a direction orthogonal to the discharge hole surface.

6. The liquid discharge head according to claim 1, wherein the flow channel member comprises a plurality of the discharge holes, a plurality of the pressurizing chambers, and a plurality of the flow channels, and has a flat plate shape, wherein a plurality of the discharge holes are disposed in me direction so as to form a plurality of discharge hole rows, wherein a plurality of the pressurizing chambers are disposed in the one direction so as to form to plurality of pressurizing chamber rows, and wherein in the pressurizing chamber connected to the partial flow channel satisfying a condition that the distance between Cm and Cl in the direction parallel to the discharge hole surface is larger than 0.1 W [μm] and the distance between C2 and C1 in the direction parallel to the discharge hole surface is 0.1 W [μm] or less, a direction being directed from the area centroid of the planar shape of the pressurizing chamber to C3 of the partial flow channel, and a direction being directed from C3 to C1 of the partial flow channel are in agreement on whether to be directed to one end or another end in the one direction.

7. A liquid discharge head, comprising:

a flat plate-shaped flow channel member that is long in a first direction and comprises a plurality of discharge holes, and a plurality of pressurizing chambers respectively connected to a plurality of the discharge holes; and a plurality of pressurizing parts configured to respectively pressurize a liquid in a plurality of the pressurizing chambers, wherein, in a plan view of the flow channel member, a plurality of the pressurizing chambers are long in one direction and are respectively connected to a plurality of the discharge holes via a first connection end that is one of opposite ends in the one direction, a plurality of the pressurizing chambers comprise the pressurizing chambers respectively having three or more different values in a value of XN [mm], a plurality of the pressurizing chambers comprise the pressurizing chamber that is positive in a maximum value XNmax [mm] of XN [mm] and is positive in XE [mm], and a plurality of the pressurizing chambers comprise the pressurizing chamber that is negative in a minimum value XNmin [mm] of XN [mm] and is negative in XE [mm], wherein, assuming that one end in the first direction in the flow channel member is taken as one end, a id another end thereof is taken as another end, XE [mm] is a relative position of the first connection end of the pressurizing chamber with respect to an area centroid of the pressurizing chamber when a side of the one end in the first direction is positive, and XN [mm] is a relative position of the discharge hole connected to the pressurizing chamber with respect to the area centroid of the pressurizing chamber when the side of the one end in the first direction is positive.

8. The liquid discharge head according to claim 7, wherein a planar shape of a plurality of the pressurizing chambers has a width being decreased toward the first connection end on a side dose to the first connection end in the one direction.

9. The liquid discharge head according to claim 7, wherein a plurality of the pressurizing chambers are disposed on a plurality of columns along a column direction that is a direction intersecting the first direction, in the pressurizing chamber that is XNmax [mm] in the value of XN [mm] , there are 45 degrees or more in an angle θ to be formed by a straight line connecting Cn and C3 connected to the pressurizing chamber, and the column direction, and in the pressurizing chamber that is XNmin [mm] in the value of XN [mm], there are 45 degrees or more in an angle θ to be formed by a straight line connecting Cn and C3 connected to the pressurizing chamber, and the column direction, wherein Cn is an area centroid of an opening a the discharge hole, and C3 is an area centroid of a shape of the opening on a side of the partial flow channel connecting the pressurizing chamber and the discharge hole which is close to the pressurizing chamber in the plan view of the flow channel member.

10. The liquid discharge head according to claim 7, wherein, in the plan view of the flow channel member, the pressurizing chamber that is positive in XE [mm] has an XN [mm] in a range of XNmin+(XNmax−XNmin)/3 [mm] to XNmax [mm], and the pressurizing chamber that is negative in XE [mm] has an XN [mm] in a range of XNmin [mm] to XNmax−(XNmax−XNmin)/3 [mm].

11. The liquid discharge bead according to claim 7, wherein, in the plan view of the flow channel member, a plurality of the pressurizing chamber have an XE [mm] in a range of XNmin/2 [mm] to XNmax/2 [mm], the pressurizing chamber that is positive in XE [mm] has an XN [mm] in either one of a range of XNmin+(XNmax−XNmin)/12 [mm] to XE−(XNmax−XNmin)/12 [mm] and a range of XE+(XNmax−XNmin)/12 [mm] to XNmax [mm], and the pressurizing chamber that is negative in XE [mm] has an XN [min] in either one of a range of XNmin [mm] to XE−(XNmax−XNmin)/12 [mm] and a range of XE+(XNmax−XNmin)/12 [mm] to XNmax−(XNmax−XNmin)/12 [mm].

12. The liquid discharge head according to claim 7, wherein the flow channel member comprises one or a plurality of common flow channels respectively connected to a plurality of the pressurizing chambers, wherein a plurality of the pressurizing chambers are respectively connected to the common flow channel via a second connection end that is another of the opposite ends in the one direction, and wherein, in the plan view of the flow channel member, the pressurizing chamber that is positive in XE [mm] has a negative XT [mm] and the pressurizing chamber that is negative in XE [mm] has a positive XT [mm], wherein XT [mm] is a relative position of a portion of the pressurizing chamber which is connected to the common flow channel with respect to an area centroid of the pressurizing chamber when a side of the one end in the first direction is positive.

13. The liquid discharge head according to claim 12, wherein a planar shape of a plurality of the pressurizing chambers has a width being decreased toward the second connection end on a side close to the second connection end in the one direction.

14. The liquid discharge head according to claim 12, wherein a plurality of the pressurizing chambers are disposed on a plurality of rows along the first direction and on a plurality of columns along a column direction that is a direction intersecting the first direction in the plan view of the flow channel member, and wherein, when a tilt direction of the pressurizing chamber is a direction in which the one direction in each of the pressurizing chambers is tilted with respect to a second direction orthogonal to the first direction, the pressurizing chambers in one of the rows are in agreement on the tilt direction of the pressurizing chamber, a plurality of the rows comprises the rows being different in the tilt direction of the pressurizing chamber, and in two rows of the pressurizing chambers adjacent to each other, a distance between the rows being different in the tilt direction of the pressurizing chamber is larger than a distance between the rows being in agreement on the tilt direction of the pressurizing chamber.

15. The liquid discharge head according to claim 14, wherein two pressurizing chamber groups comprising a plurality of the rows are disposed apart in the column direction, the tilt direction of the pressurizing chamber is identical in each of the pressurizing chamber groups, and the tilt direction of the pressurizing chamber differs between two groups of the pressurizing chamber groups in the plan view of the flow channel member.

16. The liquid discharge head according to claim 14, wherein, in the plan view of the flow channel member, a plurality of the common flow channels exist along the first direction and are connected to the pressurizing chambers disposed in one row on each side of the common flow channel, two rows of the pressurizing chambers connected to one of the common flow channels are different in the tilt direction of the pressurizing chamber, and two rows of the pressurizing chambers connected to one of the common flow channels and another are in agreement on the tilt direction of the pressurizing chamber.

17. The liquid discharge head according to claim 14, wherein, in the plan view of the flow channel member, a plurality of the pressurizing chambers are disposed on a plurality of rows along the first direction and are separately disposed in a plurality of pressurizing chamber groups comprising a plurality of the rows disposed side by side, a plurality of the pressurizing chambers belonging to one of the pressurizing chamber groups are disposed on a plurality of columns along a second direction that is a direction approximately orthogonal to the first direction, and a plurality of the columns are disposed shiftedly in the first direction in one of the pressurizing chamber groups and another.

18. The liquid, discharge head according to claim 14, wherein, in the plan view of the flow channel member, a plurality of the pressurizing chambers are disposed on a plurality of rows along the first direction, and the pressurizing chambers belonging to the rows adjacent to each other are disposed in a staggered shape between the pressurizing chambers belonging to the rows adjacent to each other, the common flow channel extends in the first direction and is connected to the pressurizing chambers disposed in two rows on each side of the common flow channel, a plurality of the pressurizing chambers are connected to the common flow channel via one of the opposite ends which is close to the common flow channel, the pressurizing chambers belonging to one of the rows are in agreement on whether XE [mm] is positive or negative, and inner two and outer two of four rows of the pressurizing chamber rows connected to the common flow channel are respectively in agreement on whether XE [mm] is positive or negative, and the inner two rows and the outer two rows are different in whether XE [mm] is positive or negative.

19. The liquid discharge head according to claim 7, wherein the flow channel member comprises one or a plurality of common flow channels connected to a plurality of the pressurizing chambers, wherein a plurality of the pressurizing chambers are connected to the common flow channel via a second connection end that is another of opposite ends in the one direction, wherein, when XT [mm] is a relative position of a portion of the pressurizing chamber which is connected to the common flow channel with respect to an area centroid of the pressurizing chamber when a side close to the one end in the first direction is positive in the Plan view of the flow channel member, a plurality of the pressurizing chambers are disposed on a plurality of rows along the first direction and on a plurality of columns along a column direction that is a direction intersecting the first direction, the pressurizing chambers belonging to one of the rows are in agreement on whether XE [mm] is positive or negative, and the rows adjacent to each other are different in whether XE [mm] is positive or negative, and among the pressurizing chambers, the pressurizing chamber that is positive in XE [mm] has a positive XT [mm], and the pressurizing chamber that is negative in XE [mm] has a negative XT [mm].

20. The liquid discharge head according to claim 19, wherein a planar shape of a plurality of the pressurizing chambers has a width being decreased toward the second connection end on a side close to the second connection end in the one direction.

21. The liquid discharge head according to claim 7, further comprising:

a nozzle part with a cross section being narrowed near the discharge hole, and a partial flow channel excluding the nozzle part in a range from each of a plurality of the pressurizing chambers to each of a plurality of the discharge holes respectively, wherein the partial flow channel is formed so that a distance between Cm and C1 in a direction parallel to the flow channel member is larger than 0.1 W [μm] and a distance between C2 and C1 in a direction parallel to the discharge member is 0.1 W [μm] or less, wherein W [μm] is a mean diameter of the partial flow channel, C1 is an area centroid of a cross section, of the partial flow channel, parallel to the flow channel member on a side of the partial flow channel which is close to the nozzle part, C2 is an area centroid of a cross section, of the partial flow channel, parallel to the flow channel member at a position located 2 W [μm] away from a side of the partial flow channel which is close to the nozzle part in a direction orthogonal to the flow channel member, C3 is an area centroid of a cross section, of the partial flow channel, parallel to the flow channel member on a side of the partial flow channel which is close to the pressurizing chamber, and Cm is an intersection of a straight line connecting C1 and C3, and a plane parallel to the discharge hole surface at a position located 2 W [μm] away from the side close to the nozzle part in a direction orthogonal to the flow channel member.

22. A recording device, comprising:

the liquid discharge head according to claim 1;

a transport section configured to transport a recording medium with respect to the liquid discharge head; and a control section configured to control a drive of the liquid discharge head.

23. A recording device, comprising:

the liquid discharge head according to claim 7;

a transport section configured to transport a recording medium with respect to the liquid discharge head; and a control section configured to control a drive of the liquid discharge head.

* * * * *